US010148035B2

(12) United States Patent
Finona et al.

(10) Patent No.: US 10,148,035 B2
(45) Date of Patent: Dec. 4, 2018

(54) CONNECTION INTERFACES WITH COUPLING MECHANISMS

(71) Applicant: ITT Manufacturing Enterprises LLC, Wilmington, DE (US)

(72) Inventors: Michael Santos Finona, Fountain Valley, CA (US); Mario Cesar Gonzalez, Murrieta, CA (US); Alan Manara, Fullerton, CA (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 0 days.

(21) Appl. No.: 15/297,923

(22) Filed: Oct. 19, 2016

(65) Prior Publication Data

US 2017/0110827 A1 Apr. 20, 2017

Related U.S. Application Data

(60) Provisional application No. 62/244,075, filed on Oct. 20, 2015.

(51) Int. Cl.
*H01R 13/52* (2006.01)
*H01R 13/62* (2006.01)
(Continued)

(52) U.S. Cl.
CPC ..... *H01R 13/6205* (2013.01); *H01R 11/30* (2013.01); *H01R 13/052* (2013.01);
(Continued)

(58) Field of Classification Search
CPC ..... H01R 13/5202; H01R 13/5205; H01R 13/52; H01R 11/30; H01R 13/052; H01R 13/5221; H01R 13/6205
(Continued)

(56) References Cited

U.S. PATENT DOCUMENTS 3,177,462 A 4/1965 Särnmark
3,287,031 A 11/1966 Simmons et al.
(Continued)

FOREIGN PATENT DOCUMENTS

| | | |
|---|---|---|
| DE | 203 17 436 | 1/2004 |
| GB | 2 268 641 | 1/1994 |
| JP | 05-061908 | 8/1993 |

OTHER PUBLICATIONS

Extended European Search Report in Patent Application No. 16194576.1, dated Feb. 21, 2017 in 10 pages.

*Primary Examiner* — Hae Moon Hyeon
(74) *Attorney, Agent, or Firm* — Knobbe, Martens, Olson & Bear, LLP

(57) ABSTRACT

Various connection interfaces are disclosed. In some embodiments, the connection interface includes a receptacle and a connector. The receptacle can be configured to be positioned in the wall of an electrical device. The receptacle can comprise a first set of electrical contacts and a channel. The connector can be configured to be matingly engaged with the receptacle in an engaged state and to be separated from the receptacle in a disengaged state. The connector can comprise a second set of electrical contacts. Some embodiments are configured such that angled surfaces of the channel and boss interact as the connector is moved into engagement with the receptacle. This can guide the connector into the receptacle such that the first and second sets of electrical contacts are in electrical communication with each other.

27 Claims, 23 Drawing Sheets

(51) Int. Cl.
*H01R 11/30* (2006.01)
*H01R 13/05* (2006.01)
*H01R 13/11* (2006.01)
*H01R 13/631* (2006.01)
*H01R 107/00* (2006.01)

(52) U.S. Cl.
CPC ..... *H01R 13/111* (2013.01); *H01R 13/5202* (2013.01); *H01R 13/5219* (2013.01); *H01R 13/6315* (2013.01); *H01R 2107/00* (2013.01)

(58) Field of Classification Search
USPC ..... 439/271, 548, 556, 559, 680, 549, 550, 439/587, 39
See application file for complete search history.

(56) References Cited

U.S. PATENT DOCUMENTS 3,522,575 A * 8/1970 Johnson ..... H01J 5/32 174/153 R
3,594,696 A * 7/1971 Witek, Jr. ..... H01R 13/5219 277/606
3,783,434 A * 1/1974 Ransford, III ..... H01R 13/53 439/281
3,853,381 A 12/1974 Morningstar
4,518,212 A 5/1985 Rumble
4,580,868 A 4/1986 Verstijnen
4,619,640 A 10/1986 Potolsky et al.
4,647,130 A 3/1987 Blair et al.
4,736,999 A 4/1988 Marks et al.
4,767,350 A * 8/1988 Cooper ..... H01R 12/716 439/271
4,820,204 A 4/1989 Batty
4,915,641 A 4/1990 Miskin et al.
4,938,707 A 7/1990 Guimond et al.
5,376,016 A 12/1994 Inaba et al.
5,487,680 A * 1/1996 Yamanashi ..... B60R 16/0222 439/34
5,580,266 A * 12/1996 Shelly ..... H01R 13/53 439/281
5,888,101 A 3/1999 Dent et al.
5,902,155 A 5/1999 Polgar et al.
6,471,543 B1 * 10/2002 Balcombe ..... H01R 13/745 439/362
6,752,655 B1 * 6/2004 Kaczmarek ..... B60R 16/0215 29/858
6,773,286 B1 8/2004 Wu
6,796,849 B2 9/2004 Villain
6,908,344 B1 * 6/2005 Ahmed ..... H01R 12/7005 439/362
6,994,595 B2 2/2006 Baker et al.
7,097,461 B2 * 8/2006 Neidlein ..... H01R 13/24 439/39
7,144,262 B2 12/2006 Cheng
7,311,526 B2 12/2007 Rohrbach et al.
7,520,536 B2 4/2009 Tiberghien et al.
7,645,143 B2 1/2010 Rohrbach et al.
7,690,937 B2 4/2010 Daily et al.
7,749,016 B2 7/2010 Ikeya et al.
7,762,857 B2 7/2010 Ngo et al.
8,241,051 B2 * 8/2012 Yi ..... H01R 13/5202 439/271
8,360,800 B1 1/2013 Finona
8,596,881 B2 * 12/2013 Umeno ..... G02B 6/3817 385/53
8,784,132 B2 * 7/2014 Cossette ..... H01R 13/6581 439/567
8,888,500 B2 * 11/2014 Gao ..... H01R 13/17 439/39
9,017,092 B1 4/2015 McCracken et al.
9,065,205 B2 * 6/2015 Gao ..... H01R 13/5808
9,147,965 B2 * 9/2015 Lee ..... H01R 13/6205
2007/0134947 A1 6/2007 Neidlein
2011/0039435 A1 2/2011 Huang
2015/0118868 A1 * 4/2015 Choi ..... H01R 11/30 439/39
2016/0093975 A1 * 3/2016 Katiyar ..... H01F 1/147 439/38
2016/0093999 A1 * 3/2016 Powers ..... H01R 31/06 439/39

* cited by examiner

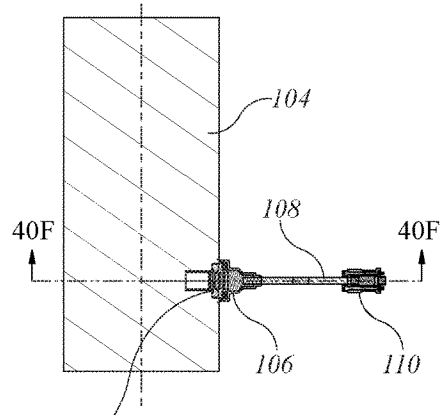
FIG. 40C
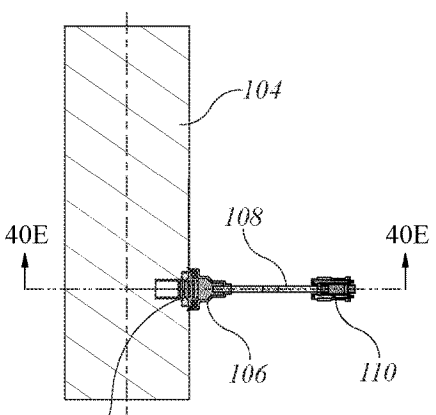
FIG. 40B
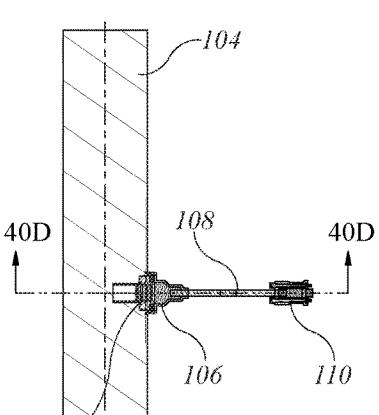
FIG. 40A
FIG. 40F
FIG. 40E
FIG. 40D

CONNECTION INTERFACES WITH COUPLING MECHANISMS

CROSS-REFERENCE

This application claims the benefit of U.S. Provisional Application No. 62/244,075, filed Oct. 20, 2015, which is hereby incorporated by reference in its entirety and made a part of this specification.

BACKGROUND

Field

The present disclosure generally relates to connection interfaces, particularly to connection interfaces with coupling mechanisms.

Certain Related Art

Electrical connectors are devices that are used to join electrical circuits using a mechanical assembly. Signals can be provided across the connector from a transmitting device to a receiving device. In some electrical connectors, the electrical connection is achieved by a user axially, laterally, and rotationally aligning a male portion with a female portion, and by the user applying a manual force to the male and/or female portions to cause the male portion to slide into the female portion.

SUMMARY OF CERTAIN FEATURES

Various embodiments of improved connection interfaces are disclosed. Some features of the connection interfaces are summarized below, however, neither this summary nor the following detailed description purports to limit or define the scope of protection. The scope of protection is defined by the claims. In several embodiments, the connection interface can comprise a connector and a receptacle. The connector and a receptacle can each include contacts, such as electrical contacts. The connector and receptacle can be configured to matingly engage to provide electrical connectivity between the contacts of the connector and the contacts of the receptacle. In some embodiments, the connector is in communication with a computing device and the receptacle is positioned on a wall of an electrical device, such as a device configured to receive information and instructions from the computing device.

The connector and receptacle can be configured to temporarily and/or detachably engage (e.g., couple). For example, the connector can be configured to be received in the receptacle in an engaged state and to be separated from the receptacle in a disengaged state. This can allow the connector to be engaged with the receptacle for a certain period (e.g., to allow for the provision and/or exchange of electrical signals between the connector and receptacle) and then to be disengaged from the receptacle. In some embodiments, the connector can be disengaged from the receptacle in response to a force withdrawing the connector from the receptacle. As described in more detail below, in some embodiments, the connector and receptacle can be drawn together (e.g., magnetically) during engagement.

The connection interface can be configured to allow engagement of the connector and receptacle in multiple orientations. This can reduce and/or eliminate the need for a user to determine the orientation of the connector relative to the receptacle to achieve engagement. For example, some embodiments are configured to reduce or avoid the need for a user to determine which face of the connector should be pointed "up" to achieve the connection with the receptacle.

In some embodiments, the connector and receptacle are adapted to engage in at least two relative orientations, such as a first orientation and a second orientation. In certain variants, the first orientation and the second orientation are approximately 180° apart. In some implementations, the connector can be converted between the first and second orientations by flipping the connector over. In some variants, the connector can be switched between the first and second orientations by rotating the connector about an axis that is substantially parallel with a coupling axis along which the connector is moved to engage with the receptacle.

In several embodiments, the connection interface can be configured such that appropriate electrical connection can be made in multiple, or any, of the engaged orientations. For example, in an embodiment in which the connector can be engaged with the receptacle in a first and a second orientation, the connector and/or receptacle can be configured such that the appropriate electrical connection is provided in both the first and second orientations. Some embodiments maintain the appropriate electrical connection in multiple orientations, in part, by the arrangement of the contacts and of the electricity carried by those contacts. For example, in certain implementations, the contacts of the connector and receptacle are arranged in upper and lower lines having the same number of contacts (e.g., 3, 4, 5, 6, 7, or otherwise). Thus, when the connector is flipped over (thereby converting the lower line of contacts to the upper line of contacts and vice versa), the same number of contacts are still provided on the upper and lower lines.

In some embodiments, the arrangement of the electricity carried by the contacts in the lower line can be a mirror image of the arrangement of the electricity carried by the contacts upper line. For example, in some embodiments, the upper line of contacts comprises, in order, first, second, and third contacts that carry, for example, power, ground, and signal, and the lower line of contacts comprises, in order, third, second, and first contacts that carry, for example, signal, ground, and power.

The connection interface can include features to aid in achieving engagement of the connector and receptacle. For example, the connector and receptacle can include guiding shapes. The guiding shapes on the connector and receptacle can cooperate to aid in aligning the connector relative to the receptacle and/or receiving the connector in the receptacle. In some embodiments, the guiding shapes comprise an angled groove in the receptacle and an angled boss on the connector. The angled boss of the connector can interface with the angled groove of the receptacle, such as in sliding movement. This interfacing can facilitate aligning the connector with the receptacle.

The connection interface can include features to facilitate drawing and/or maintaining the connector and receptacle together. For example, the connector and receptacle can be configured to magnetically attract each other. This can provide a magnetic attraction force that eases engagement of the connector and receptacle. For example, in response to the connector being placed in the close vicinity (e.g., less than 10 mm apart from the receptacle), the connector can be pulled into contact with the receptacle by the magnetic force. This can reduce or eliminate the need for a user to apply an axial force to the connector to achieve engagement, which can enhance convenience for the user and can reduce stress on the connector. Further, the magnetic attraction between the connector and receptacle can reduce the likelihood of unintentional disengagement. In some embodiments, the magnetic attraction force is sufficiently strong so that engagement of the connector and receptacle produces an audible and/or tactile response for the user. This can aid in signaling to the user that engagement has been achieved.

The connection interface can include features to reduce the chance of damage to the connector and receptacle in the engaged state. For example, the connection interface can include a sealing lip (e.g., a resilient gland) that can be configured to engage against the wall of the electrical device in which the receptacle is positioned. This can inhibit or prevent contaminants (e.g., dirt, dust, water, etc.) from entering the connection interface. In some implementations, the wall of the electrical device is generally cylindrical or otherwise rounded and the sealing lip is configured to engage with the rounded wall.

The connection interface can include features to reduce the chance of damage to the connector and receptacle in the disengaged state. For example, some embodiments include a first cover that can be connected to the connector and/or a second cover that can be connected to the receptacle. This can provide protection to the connector and receptacle when disengaged from each other. In some embodiments, the first cover includes an angled groove that is similar or identical to an angled groove on the receptacle, and/or the second cover includes an angled boss that is similar or identical to an angled boss on the connector.

BRIEF DESCRIPTION OF THE DRAWINGS

The various features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

FIGS. 40A-41F illustrate cross-sectional views of embodiments of a receptacle, a housing, and a connector.

DETAILED DESCRIPTION OF CERTAIN EMBODIMENTS

Figure 1:
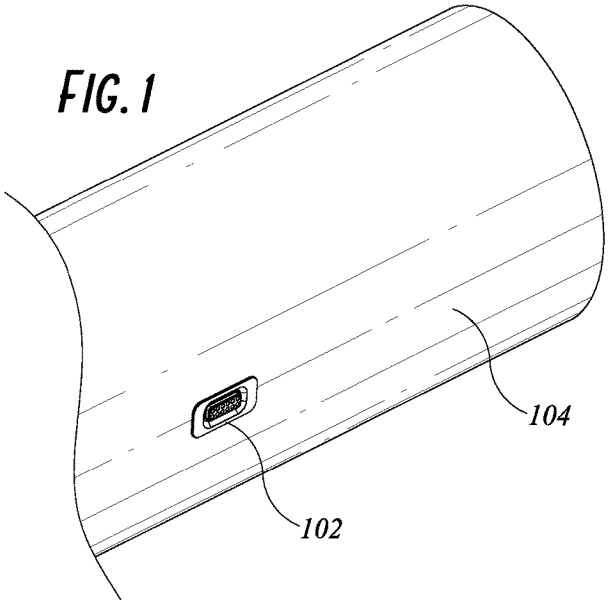
FIG. 1 illustrates a side isometric view of an embodiment of a receptacle in a housing.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and made a part of this disclosure.

In particular, embodiments disclosed herein pertain to connection interfaces, including male and female components, which utilize coupling, mating, connection, and/or engagement mechanism(s) that facilitate connecting and disconnecting the connection interfaces.

FIG. 1 illustrates a side isometric view of an embodiment of a receptacle 102 in a housing 104. The receptacle (socket, outlet, interface) 102 can be positioned in an opening of the housing 104. As illustrated in FIG. 1, exterior surfaces of the receptacle 102 can be substantially or generally flush with exterior surfaces of the housing 104. The housing 104 can be of various shapes and sizes as discussed further herein. For example, as illustrated in FIG. 1, the housing 104 can be or have a surface that is generally round, circular, cylindrical, etc. In some embodiments, the exterior surface where the receptacle 102 is housed may be substantially flat (e.g., the housing is polygonal). The receptacle 102 can be a low-profile device to, for example, provide a contoured aerodynamic interface. In some embodiments, if the housing 104 is moving through a fluid, such as water or air, the receptacle 102 can be positioned, sized, and/or shaped such that resistance or drag due to the receptacle 102 is minimized.

The housing 104 can be a casing or enclosure for an electronic device. The receptacle 102 can provide electrical connections or interface to internal components of the electronic device. In some embodiments, the housing 104 can be a casing or enclosure for containing materials. The receptacle 102 can provide an interface to, for example, take measurements for desired properties of the materials contained by the housing 104. For example, the housing 104 may be a pipe. The materials may be a process flow and the receptacle 102 provides an interface to internal physical property sensors, such as for example, temperature pressure and/or flow velocity.

Figure 2:
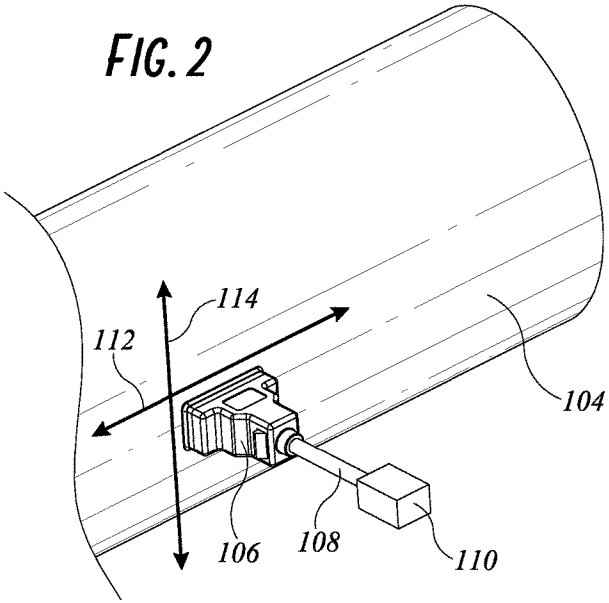
FIG. 2 illustrates a side isometric view of an embodiment of a connector engaged with a receptacle in the housing.
Figure 4:
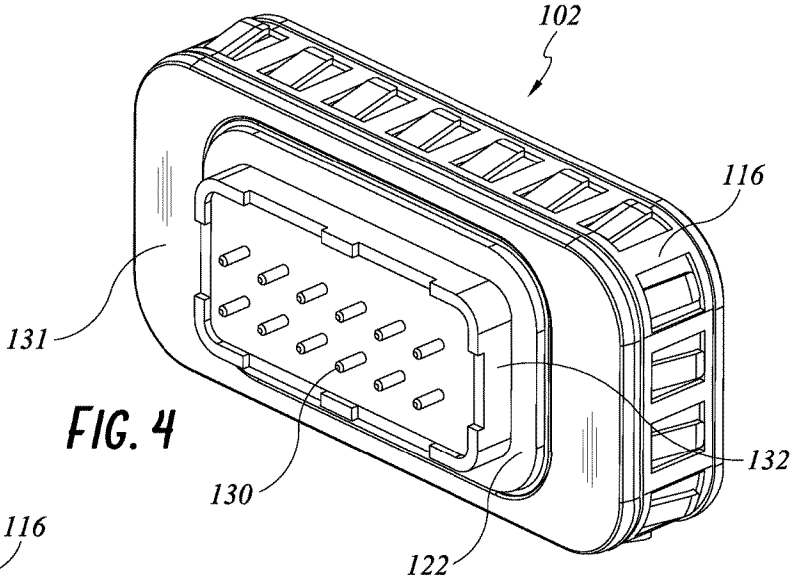
FIGS. 4 and 5 illustrate top, back, side, isometric views of embodiments of a receptacle.
Figure 3:
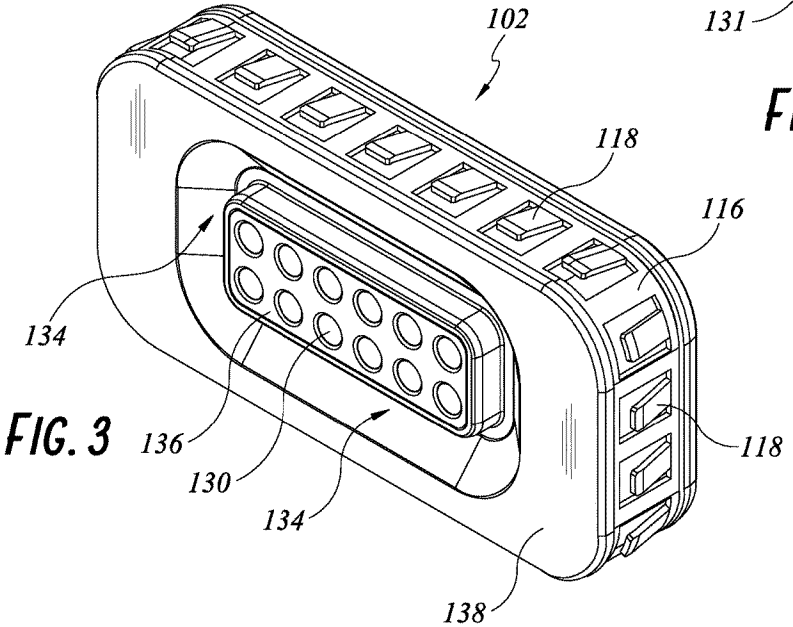
FIG. 3 illustrates a top, front, side, isometric view of an embodiment of a receptacle.
Figure 5:
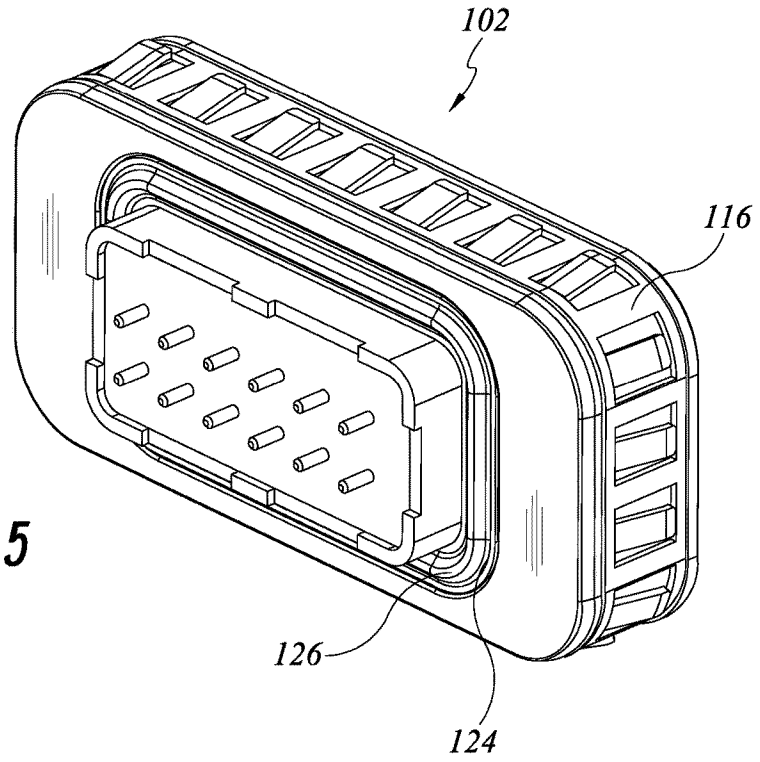
Figures 6, 7, 8, 9:
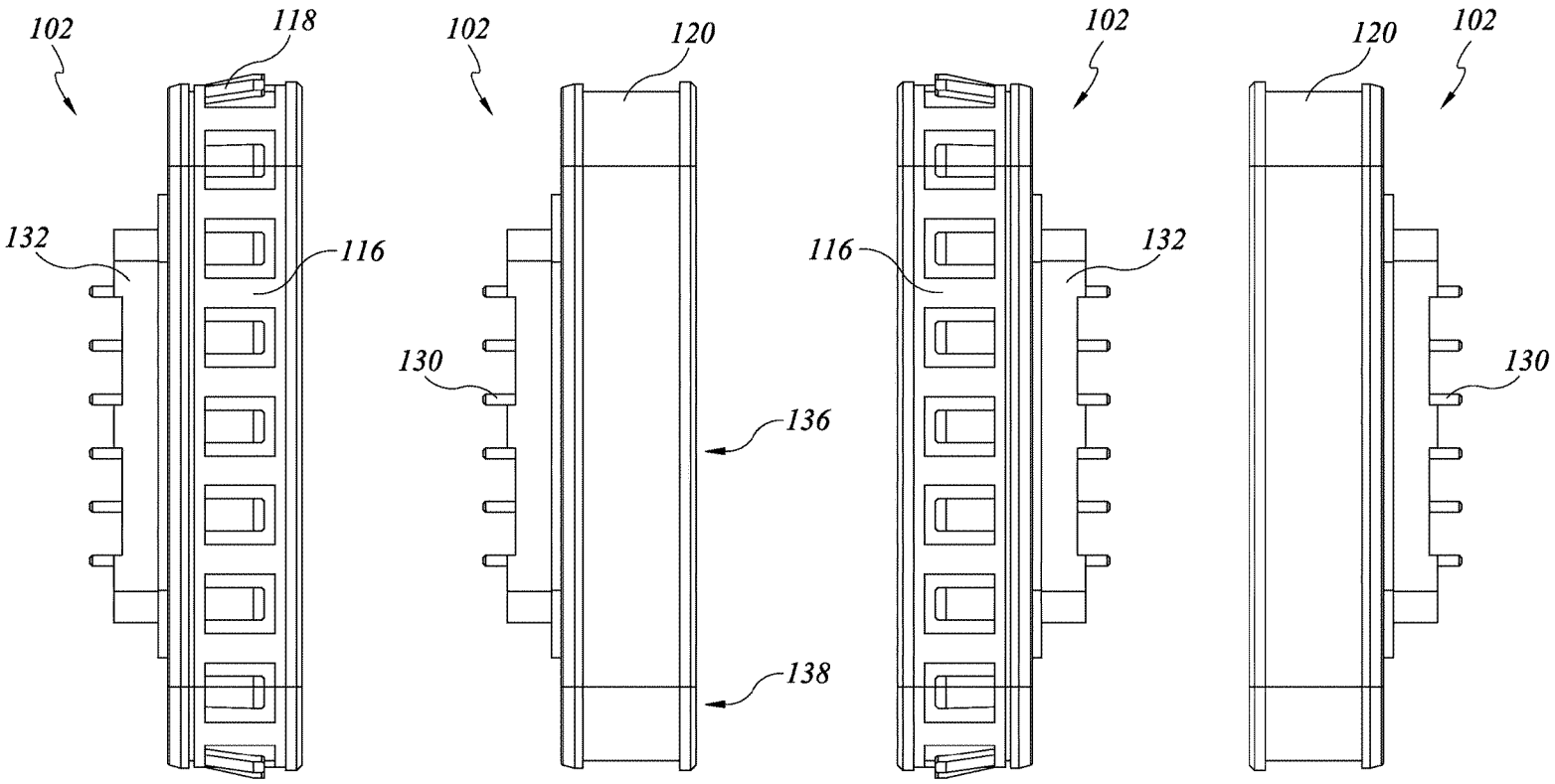
FIGS. 6 and 7 illustrate bottom side views of embodiments of a receptacle.
FIGS. 8 and 9 illustrate top side views of embodiments of a receptacle.
Figure 11:
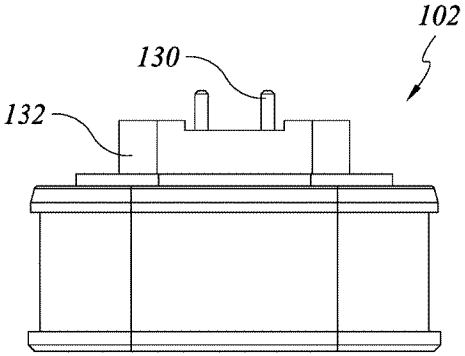
FIGS. 10 and 11 illustrate left side views of embodiments of a receptacle.
Figure 13:
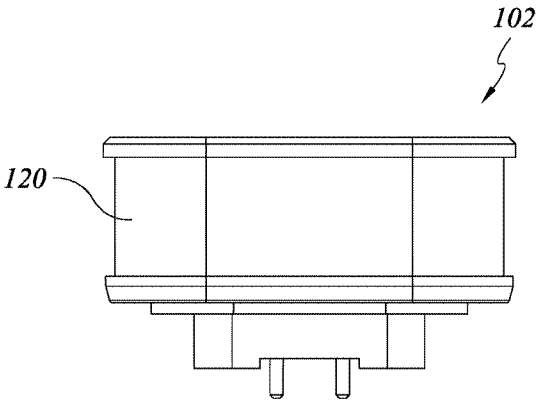
FIGS. 12 and 13 illustrate right side views of embodiments of a receptacle.
Figure 10:
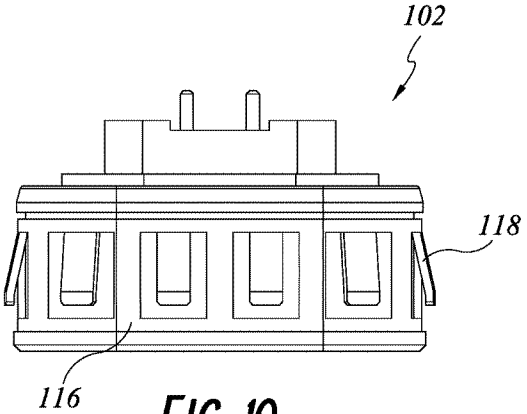
Figure 12:
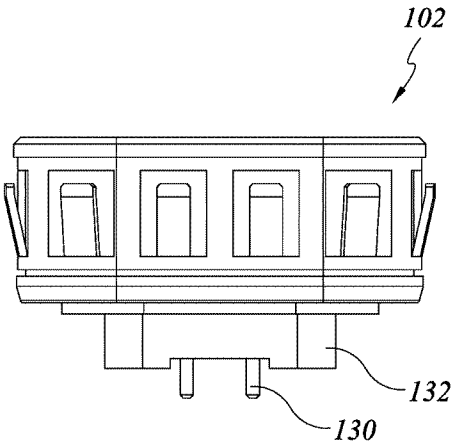
Figure 15:
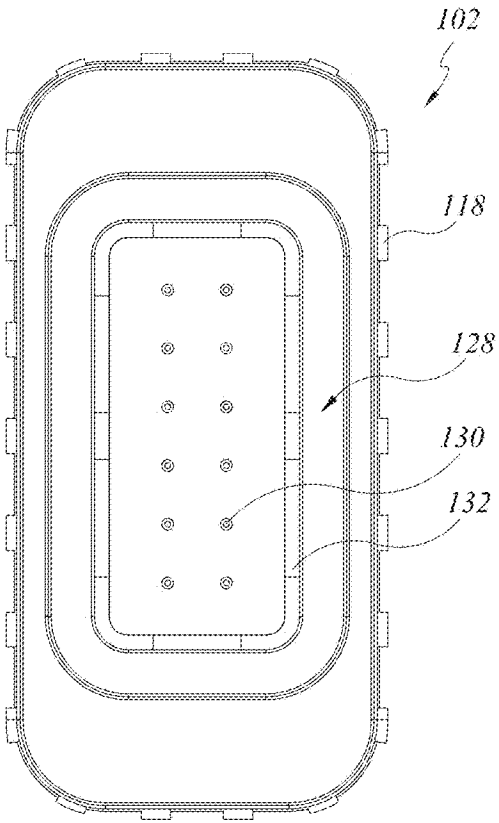
FIG. 15 illustrates a back view of an embodiment of a receptacle.
Figure 14:
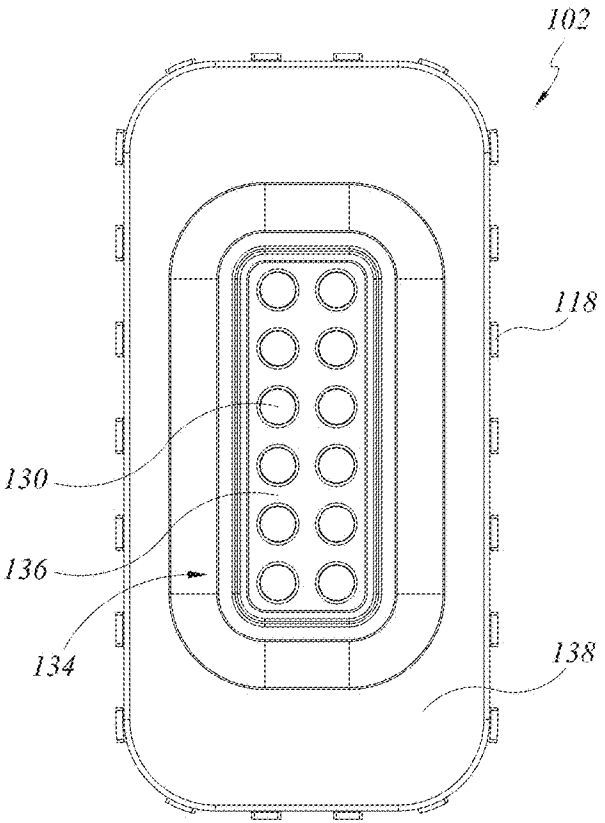
FIG. 14 illustrates a front view of an embodiment of a receptacle.

FIG. 2 illustrates a side isometric view of an embodiment of a connector 106 engaged with a receptacle 102 in the housing 104 via connection interfaces as discussed herein. The connector 106 can be connected to a cable 108 that can provide an electrical connection 110 to another electronic device. For example, the other electronic device can be an electronic computing device, such as for example, a desktop computer, a laptop computer, a tablet computer, and/or phone computer. In some embodiment, the other electronic device comprises a controller unit (e.g., a processor and a memory).

As discussed herein, the connector (plug, adapter, link) 106 can be easily connected and disconnected (interconnected and unconnected, coupled and uncoupled, mated, and unmated, and/or engaged and disengaged) to the receptacle 102. The receptacle 102 and the connector 106 can be engaged via various coupling mechanisms as discussed herein. The coupling mechanisms can engage the connector 106 with the receptacle 102 to provide a secure connection in a 3-D space. For example, the connector 106 can be engaged with the receptacle 102 such that longitudinal seals 112 and/or lateral seals 114 are formed (or any combination of directions), including substantially preventing or inhibiting movement in predetermined directions (e.g., longitudinal, lateral, and/or any combination of directions thereof). The receptacle 102 and the connector 106 can be coupled via magnetic forces, canted spring, frame, mechanical push-pull, and/or clip-locking actuation or sleeve.

FIGS. 3-15 illustrate various views of embodiments of a receptacle 102. The receptacle 102 can be positioned in the housing 104 as discussed herein using a circumferential housing gasket 116. The housing gasket 116 can have fingers or tentacles 118 that extend outwardly or away from exterior surfaces of the receptacle 102 to mate with and/or engage with corresponding grooves, cutouts, or notches 119 (FIG. 36) in the housing 104 to facilitate securely positioning the receptacle 102 within the housing 104. In some embodiments, the fingers 118 engage a substantially flat or uniform surface of the housing 104 while providing a secure engagement as discussed herein. The housing gasket 116 can be shaped and sized to be positioned in a gasket channel 120 of the receptacle 102 to securely fix the housing gasket 116 relative to the body of the receptacle 102.

The receptacle 102 can have other gaskets. For example, the receptacle 102 can have a sealing gasket 122. The sealing gasket 122 can have a flat exterior surface that mates against a surface (when the sealing gasket 122 is compressed) within the opening of the housing 104 to provide a debris and/or fluid seal. In some embodiments, the receptacle 102 can have a sealing gasket 124 with a projection 126. The projection 126 can be compressed against a surface within the opening of the housing 104 to provide a further tight seal. The sealing gaskets 122, 124 can be positioned in a sealing channel 128 that extends substantially along a perimeter of the receptacle 102 and/or about electrical contacts 130 (circumscribing about a central axis 168 (see FIG. 36) to at least partially enclose electrical contacts 130 on an internal surface 131 of the receptacle 102 relative to the housing 104).

The receptacle 102 can have electrical contacts 130. The electrical contacts 130 can provide electrical communication between the connector 106 and the electronic components within the housing 104 as discussed herein. The electrical contacts 130 can be positioned within a chamber or opening provided within a flange 132 of the receptacle 102 to provide a sealed and robust passageway between the exterior and interior of the housing 104.

The electrical contacts 130 can be positioned in, circumscribed in, and/or surrounded by a channel (groove, cutout, depression, notch, slit) 134. The channel 134 can have various surfaces that are straight, perpendicular, beveled, and/or chamfered to facilitate engagement with the connector 106 as discussed herein. The electrical contacts 130 can be positioned in or along an exterior surface 136 of the receptacle 102 (relative to the housing 104). The channel 134 can be positioned in an exterior surface 138 of the receptacle 102 (relative to the housing 104) that is proximate to the perimeter of the receptacle 102. The exterior surfaces 136, 138 can be substantially or generally flush (substantially positioned within or along a plane). The channel 134 can extend axially inward or into the exterior surfaces 136, 138 (e.g., toward the interior surface 131). Accordingly, the receptacle 102 can have an aerodynamic low-profile within the housing 104, as well as provide minimal or desired friction or drag against any fluid moving relative to the housing 104.

Figure 17:
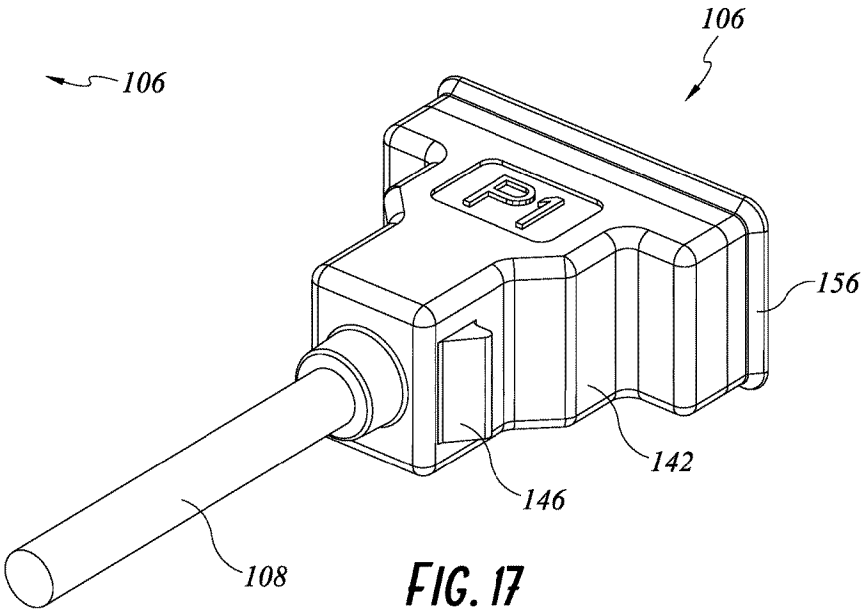
FIG. 17 illustrates a top, back, side, isometric view of an embodiment of a connector and cable.
Figure 16:
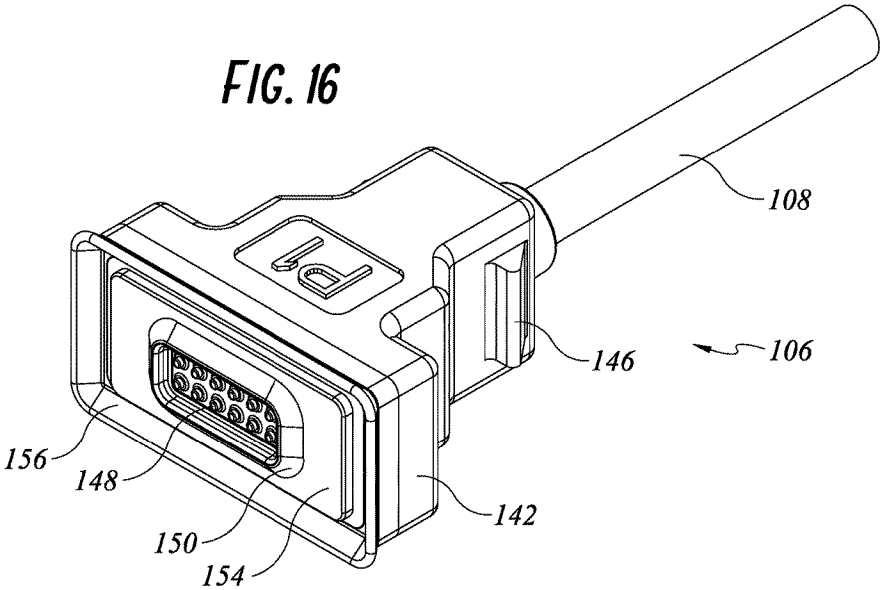
FIG. 16 illustrates a top, front, side, isometric view of an embodiment of a connector and cable.
Figure 19:
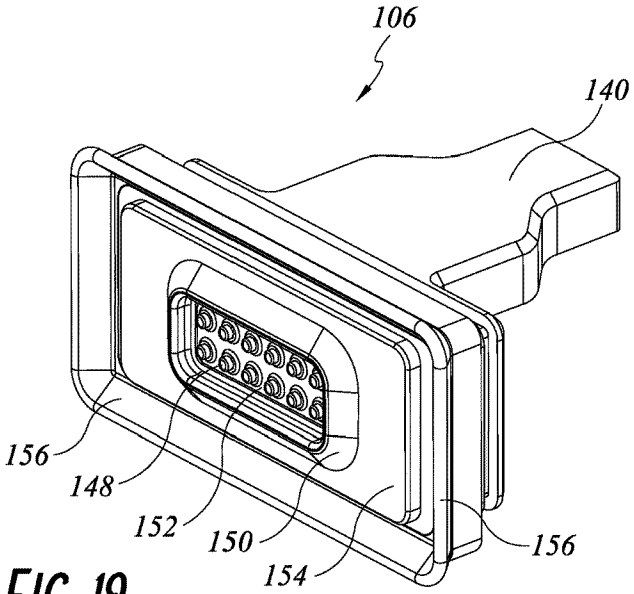
FIG. 19 illustrates a bottom, front, side, isometric view of an embodiment of a connector.
Figure 18:
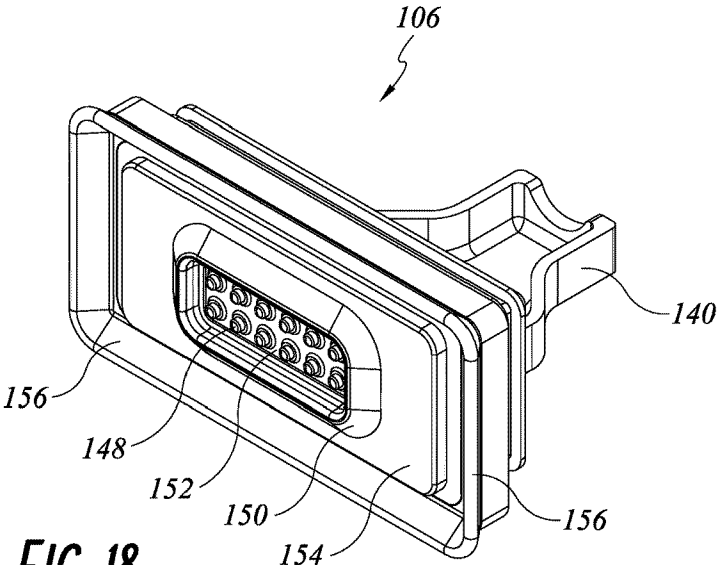
FIG. 18 illustrates a top, front, side, isometric view of an embodiment of a connector.
Figure 21:
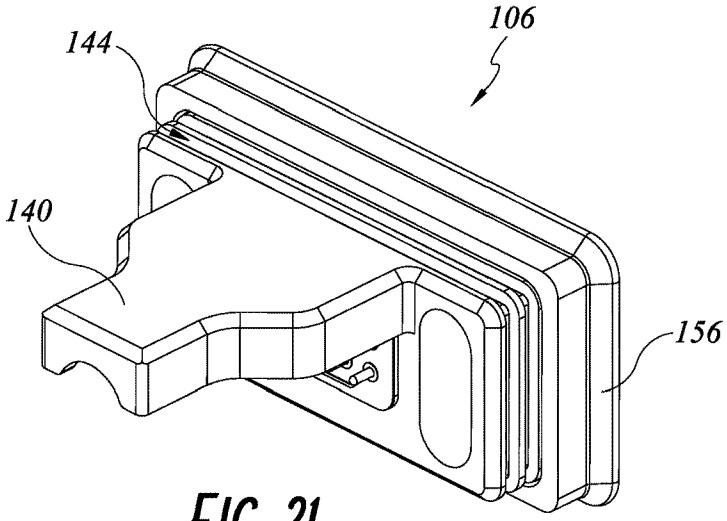
FIG. 21 illustrates a bottom, back, side, isometric view of an embodiment of a connector.
Figure 20:
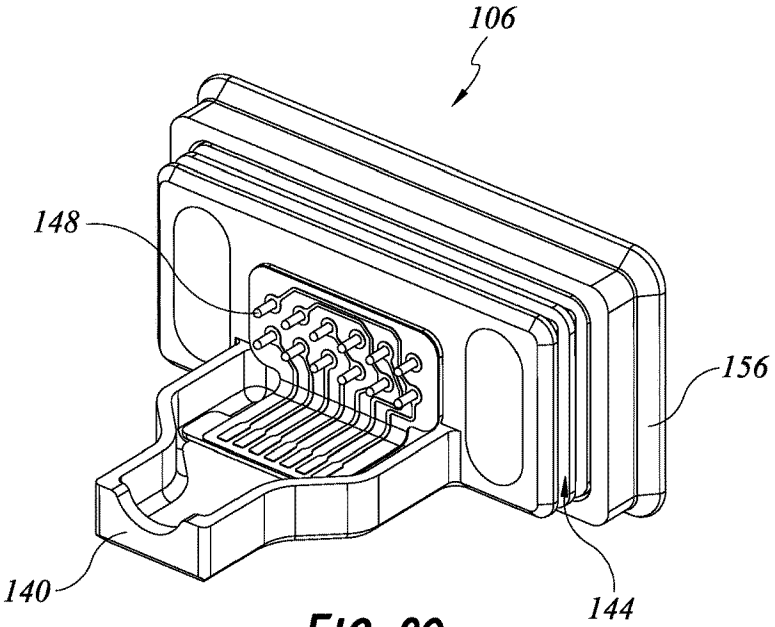
FIG. 20 illustrates a top, back, side, isometric view of an embodiment of a connector.
Figure 23:
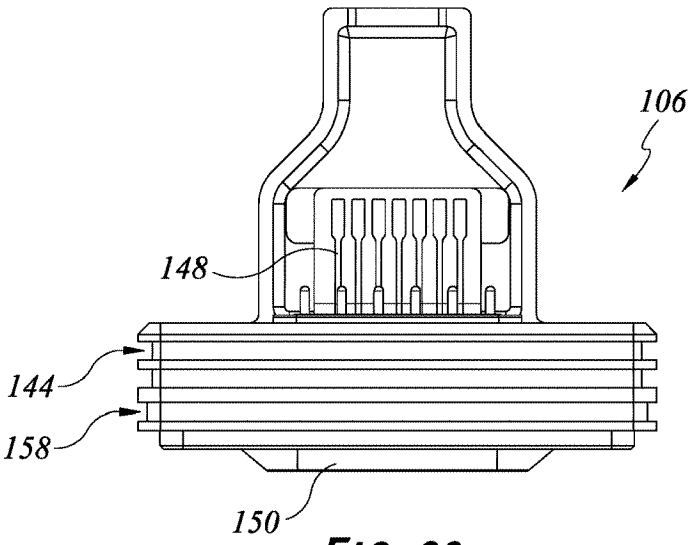
FIGS. 22 and 23 illustrate top side views of embodiments of a connector.
Figure 22:
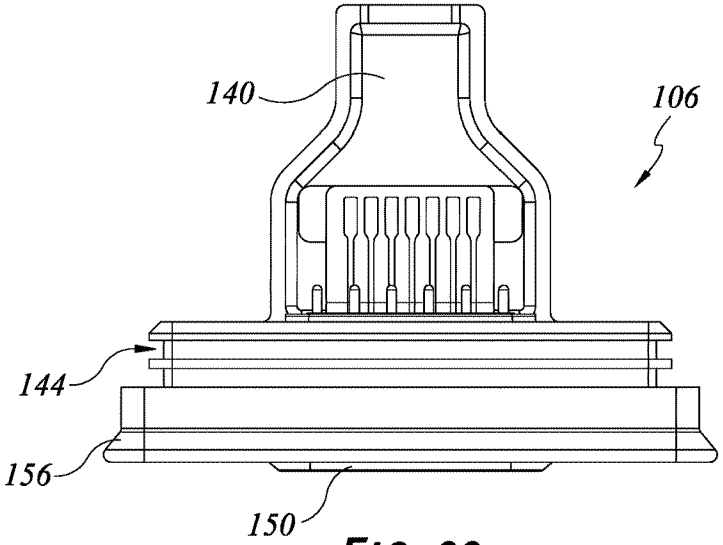
Figure 25:
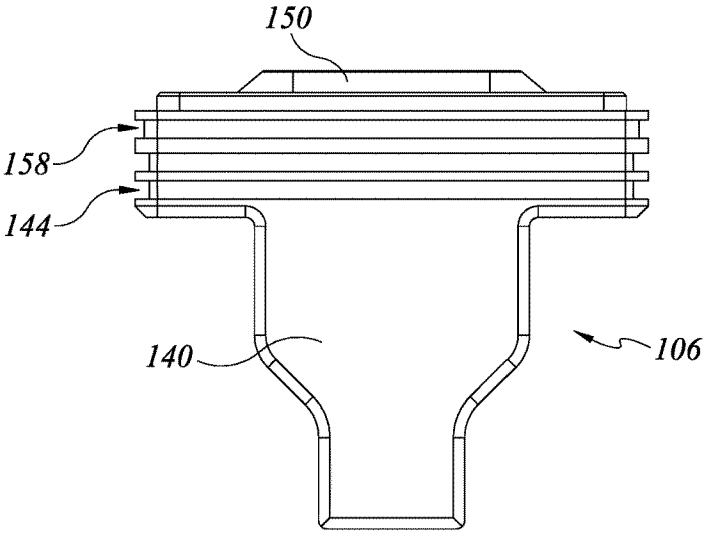
FIGS. 24 and 25 illustrate bottom side views of embodiments of a connector.
Figure 24:
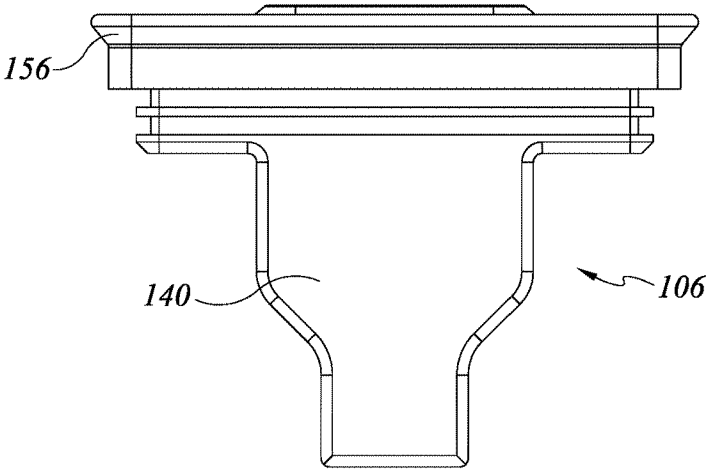
Figure 27:
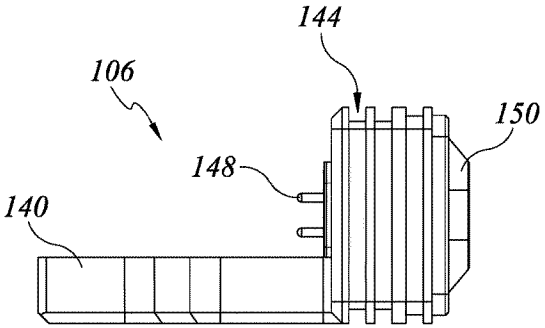
FIGS. 26 and 27 illustrate left side views of embodiments of a connector.
Figure 29:
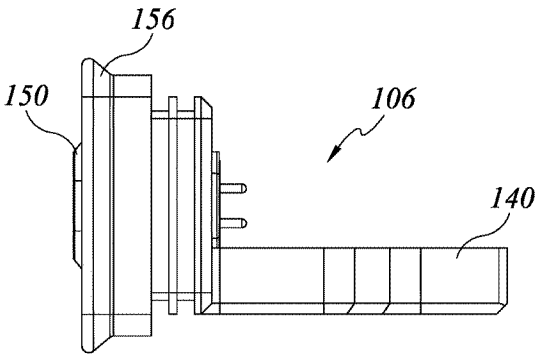
FIGS. 28 and 29 illustrate right side views of embodiments of a connector.
Figure 26:
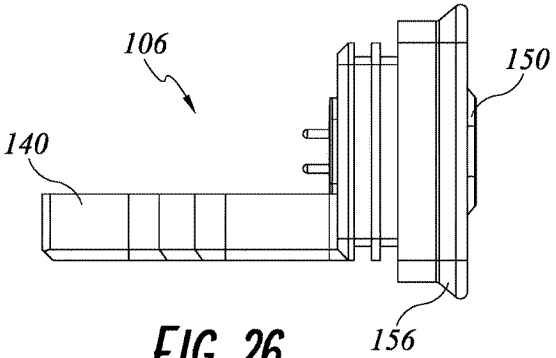
Figure 28:
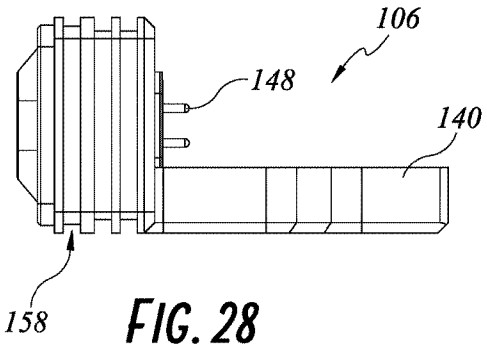
Figure 31:
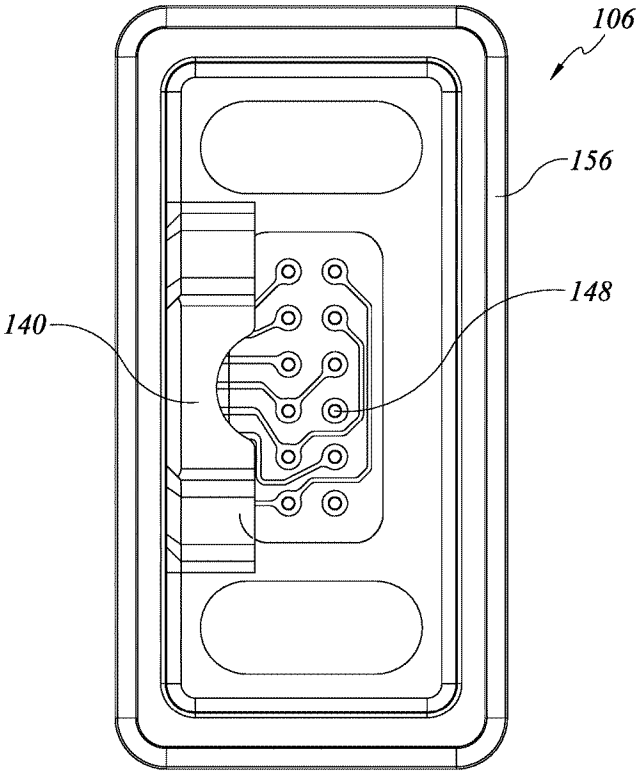
FIG. 31 illustrates a back view of an embodiment of a connector.
Figure 30:
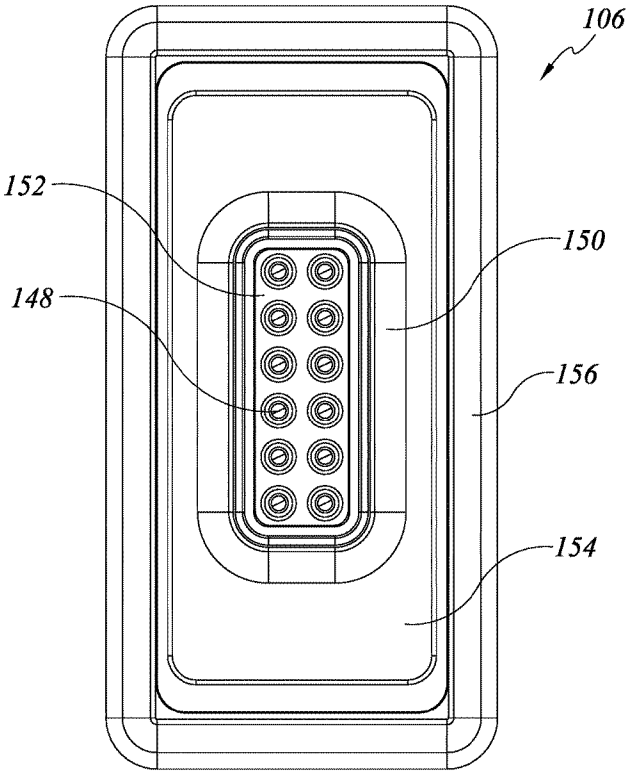
FIG. 30 illustrates a front view of an embodiment of a connector.

FIGS. 16-31 illustrate various views of embodiments of a connector 106. As discussed herein, and as shown in FIGS. 16 and 17, the connector 106 can be connected to a cable 108. As discussed above, the cable 108 can have electrical wires connecting to an electrical connection 110. The connector 106 can have a projection 140, which can be sized and shaped to position and/or engage the cable 108 relative to the connector 106. However, for purposes of presentation, the cable 108 is not shown in FIGS. 18-31. The connector 106, cable 108, and/or projection 140 can be positioned or enclosed by a receptacle casing 142. The receptacle casing 142 can connect, mate, and/or engage with the connector 106 via casing channels 144 that are sized and shaped to accept corresponding projections from the receptacle casing 142 (or vice versa). The receptacle casing 142 can have gripping features (e.g., knobs, protrusion, or otherwise) 146 that a user can grip to facilitate engagement and disengagement of the connector 106 with the receptacle 102 as discussed herein.

The cable 108 can be in electrical communication with electrical contacts 148 of the connector 106. The electrical contacts 148 can be surrounded by, circumscribed by, positioned within a perimeter of a boss (projection, protrusion, rim, ridge) 150. The boss 150 can extend generally along and/or generally parallel to the periphery of the connector 106. The boss 150 can have various surfaces that are straight, perpendicular, beveled, and/or chamfered to facilitate engagement with the receptacle 102 as discussed herein. The boss 150 can be sized and shaped to connect, engage, and/or mate with the channel 134 as discussed herein.

The electrical contacts 148 can be positioned in or along an exterior surface 152 of the receptacle 102. The boss 150 can be positioned in or on an exterior surface 154 of the receptacle 102 that is proximate to the perimeter of the receptacle 102. The exterior surfaces 152, 154 can be substantially or generally flush (substantially positioned within or along a plane). The boss 150 can extend (project) axially outward or away from the exterior surfaces 152, 154. Accordingly, the boss 150 (as well as the connector 106 in general) can provide a housing that protects the electrical contacts 148 from damage. The arrangement of the electrical contacts 148 within the boss 150 in a substantially fixed position can substantially inhibit or prevent bending or kinks in the electrical contacts 148 and/or corresponding wiring.

The connector 106 can have a gland (gasket, cover, cap, etc.) 156. The gland 156 can have edges for ends that extend axially past the exterior surfaces 152, 154. When the receptacle 102 and the connector 106 are connected, the ends of the gland 156 can be pressed against an exterior surface of the housing 104. Accordingly, the gland 156 can be compressed against the exterior surface of the housing 104 to provide an interference fit between the gland 156 and the housing 104. The interference fit can provide a seal against the debris and/or fluids of the connection interface as discussed herein. The gland 156 can be connected to, engage with, and/or mated with the connector 106 (secured to the connector 106 and/or substantially securely fixed relative to the connector 106 at an outer periphery or peripheral wall of the connector 106) via, for example, a gland channel 158 that is sized and shaped to accept corresponding projections from the gland 156 (or vice versa).

Figure 32:
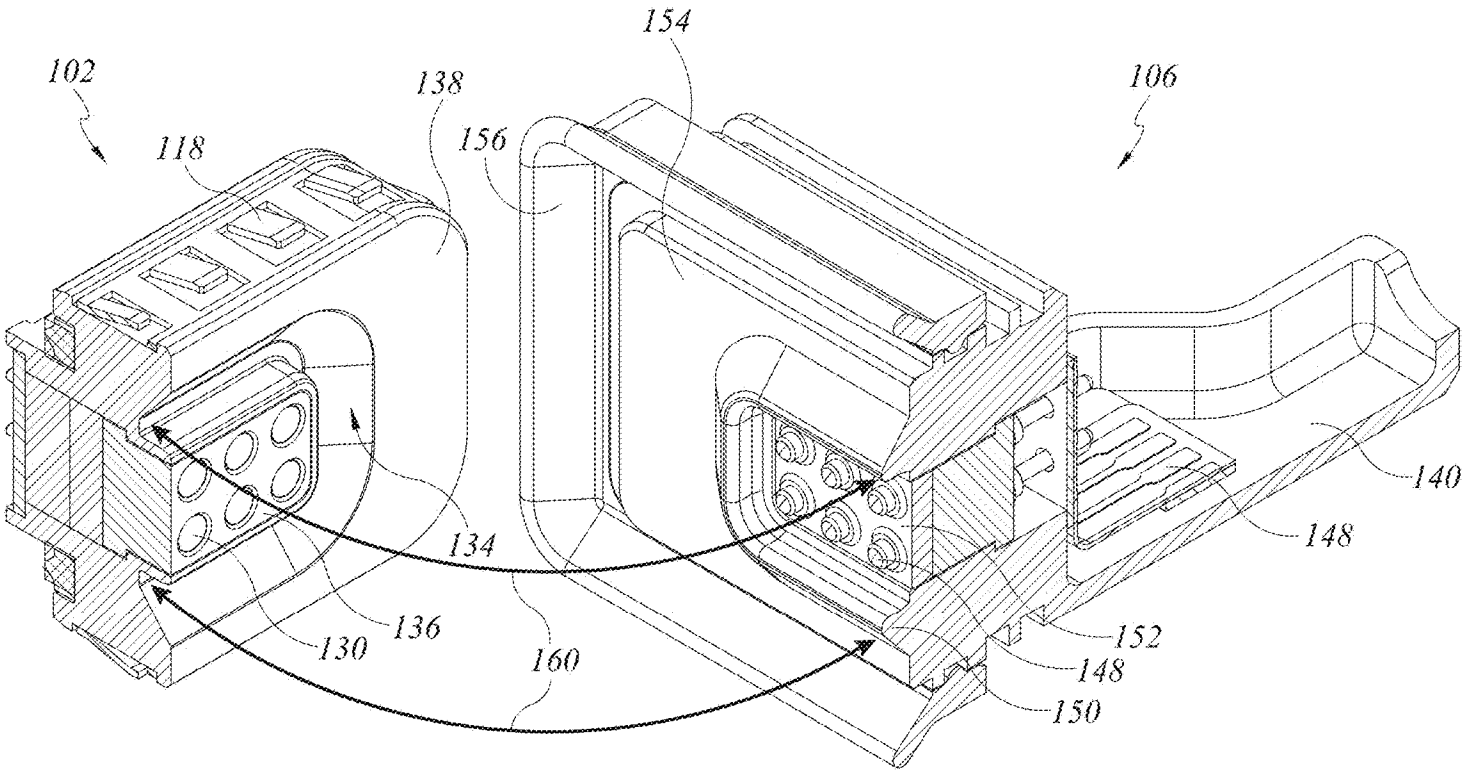
FIGS. 32 and 33 illustrate cross-sectional side isometric views of embodiments of a receptacle and a connector.
Figure 33:
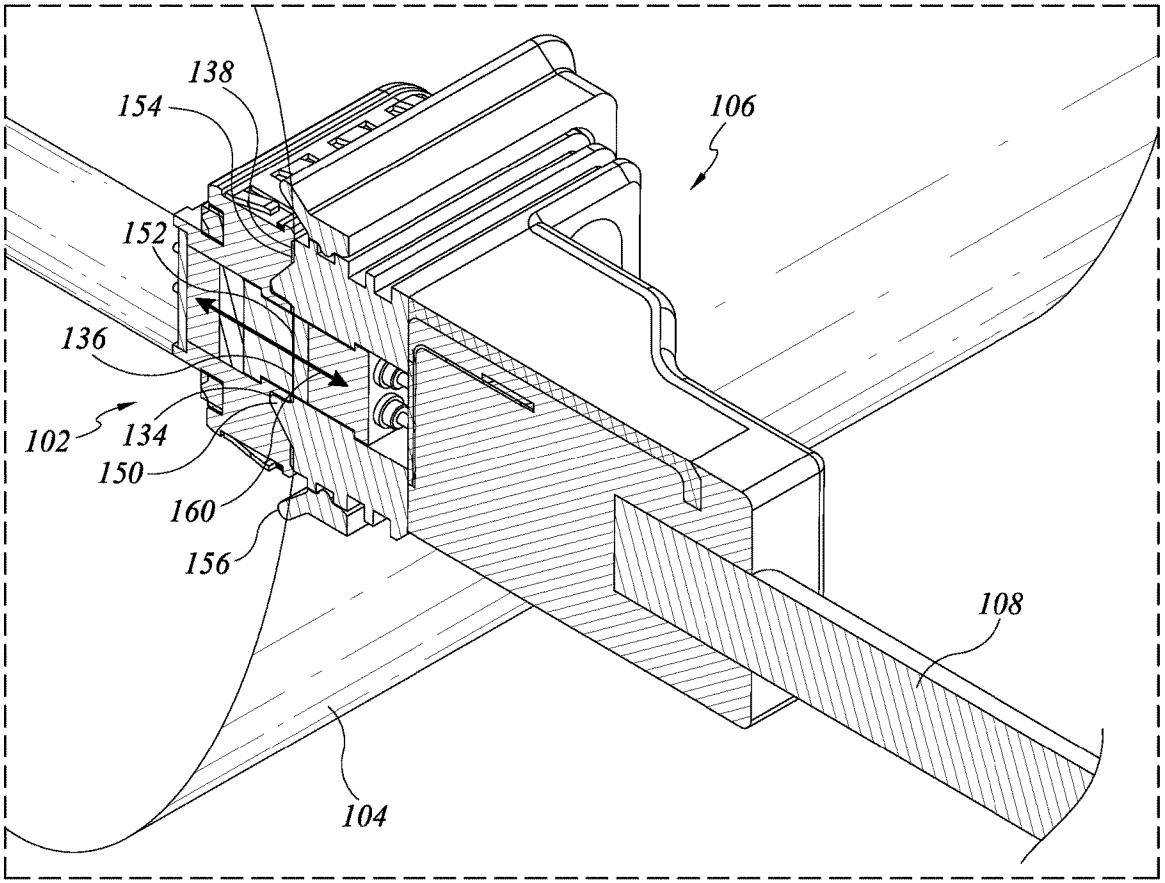

FIGS. 32 and 33 illustrate the connection interfaces of the receptacle 102 and the connector 106 engaging to form a contoured lateral seal as discussed herein, including forming electrical connections between the electrical contacts 130, 148. As illustrated, the receptacle 102 and the connector 106 can be engaged along directional arrows 160. Upon engagement of the boss 150 with the channel 134, lateral movement (e.g., up-and-down relative to FIGS. 32 and 33, see also FIG. 1) can be substantially inhibited and/or prevented. For purposes of presentation, in FIG. 32 the connector 106 is shown without the cable 108, however the cable 108 is shown in FIG. 33. As mentioned above, the cable 108 can be in electrical communication with the electrical contacts 148 (e.g., pins, traces, etc.) of the connector 106.

Figure 34:
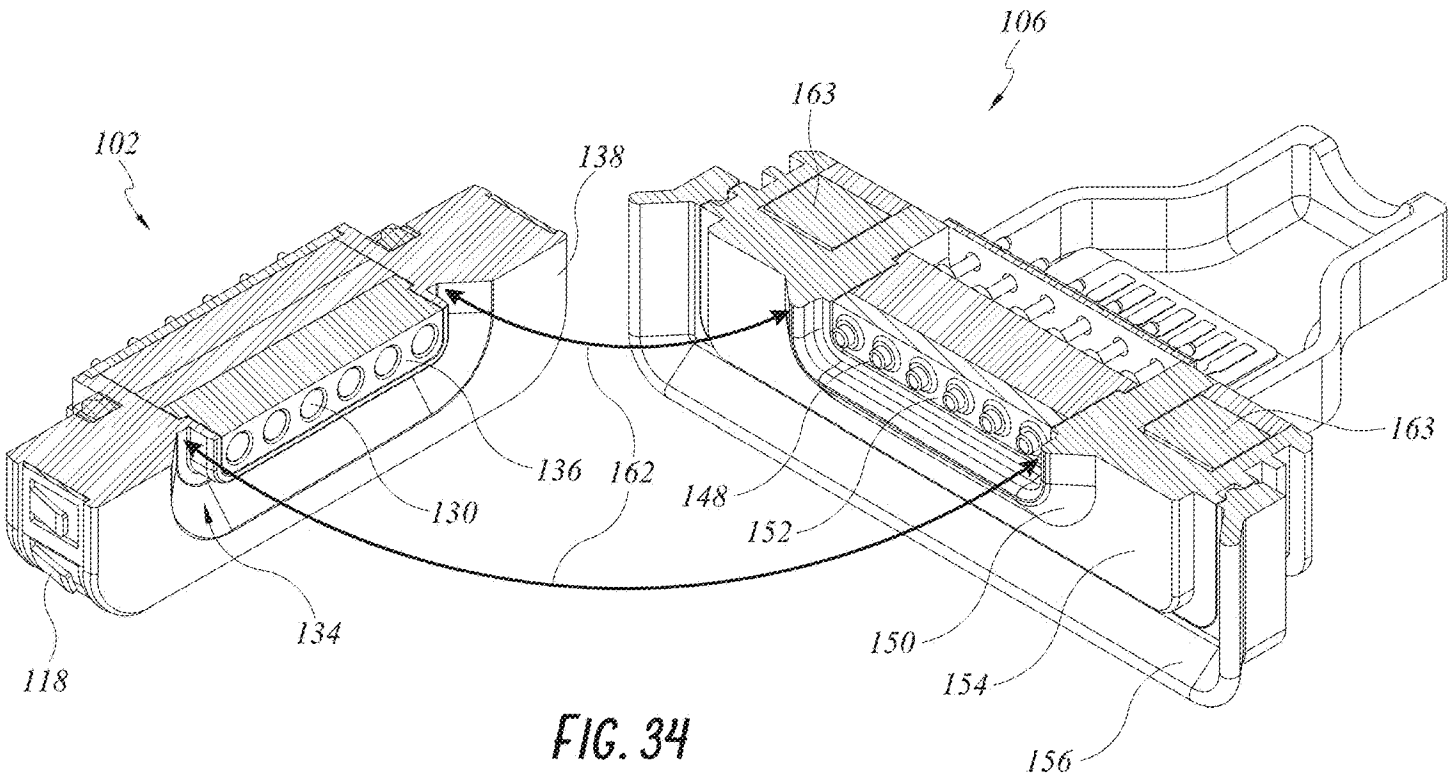
FIGS. 34 and 35 illustrate cross-sectional top isometric views of embodiments of a receptacle and a connector.
Figure 35:
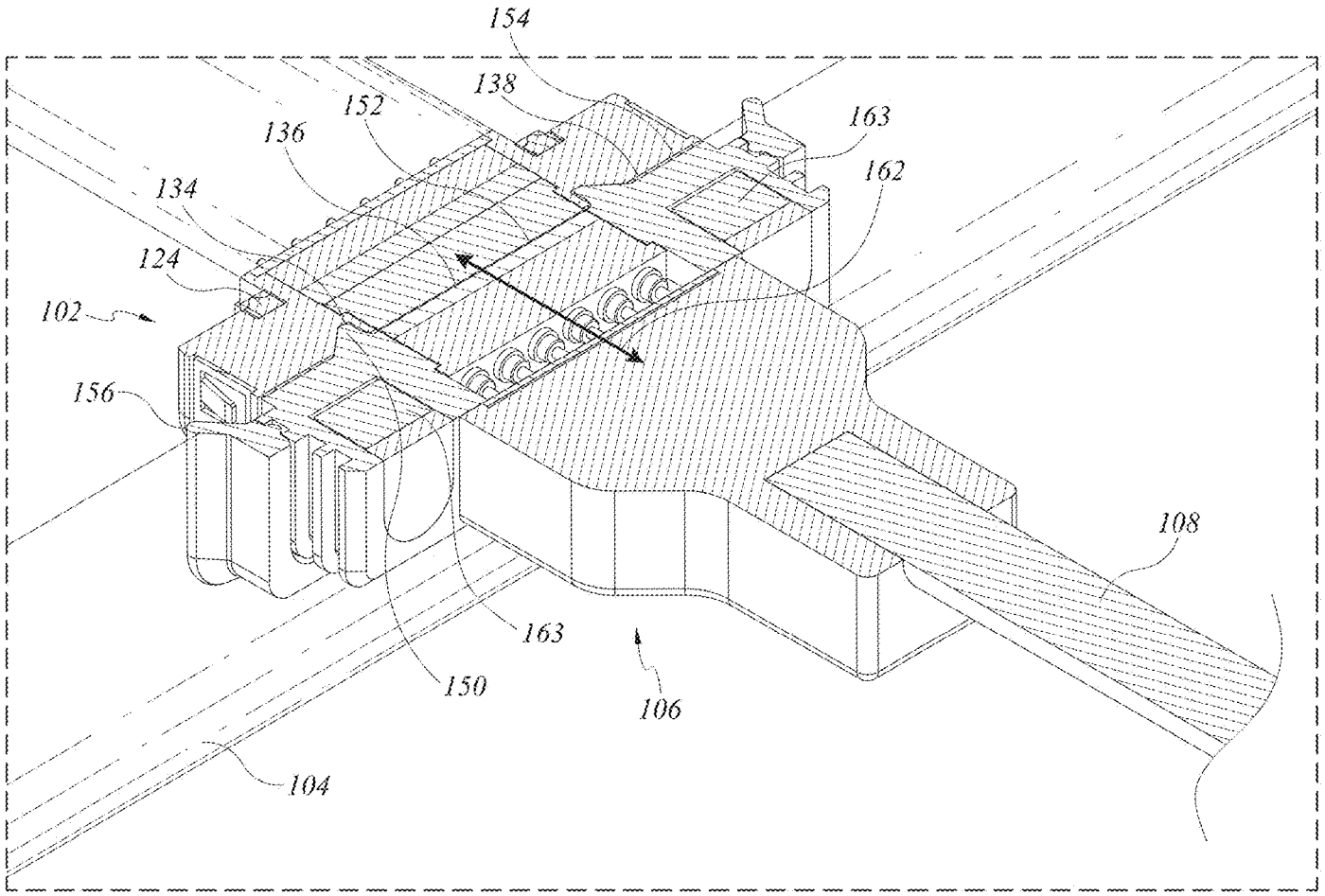

FIGS. 34 and 35 illustrate the connection interfaces of the receptacle 102 and the connector 106 engaging to form a contoured longitudinal seal as discussed herein, including forming electrical connections between the electrical contacts 130, 148. As illustrated, the receptacle 102 and the connector 106 can be engaged along directional arrows 162. Upon engagement of the boss 150 with the channel 134, longitudinal movement (e.g., up-and-down relative to FIGS. 34 and 35, see also FIG. 1) can be substantially inhibited and/or prevented. Again, for purposes of presentation, in the connector 106 is shown without the cable 108 in FIG. 34, but is shown with the cable 108 in FIG. 35.

FIGS. 33 and 35 illustrate an interference fit between an exterior surface of the housing 104 and the gland 156. Upon engagement of the receptacle 102 and the connector 106, the gland 156 is compressed and/or flexed against the exterior surface of the housing 104 to form a tight seal as discussed herein.

Engagement of the receptacle 102 and the connector 106 along directional arrows 160, 162 can be facilitated by magnetic attractive forces between the receptacle 102 and the connector 106. The receptacle 102 and/or the connector 106 can have a magnetic element 163 to produce attractive forces as discussed herein. For example, the exterior surface 136 and/or exterior surface 138 of the receptacle 102 can be magnetic. The exterior surface 152 and/or exterior surface 154 of the connector 106 can be magnetic. In some embodiments, the body or portions of the body of the receptacle 102 can be metallic and magnetic to be the magnetic element. In some embodiments, the body or portions of the body of the connector 106 can be metallic and magnetic to be the magnetic element. The receptacle 102 or the connector 106 may have a magnetic element while the other can be metallic to provide magnetic forces as discussed herein.

Magnetic attractive forces can facilitate the connection interfaces of the receptacle 102 and the connector 106 to be a self-guided coupling mechanism. For example, magnetic forces can help guide the boss 150 into the channel 134 even if the boss 150 is not fully aligned with the channel 134 upon engagement by a user. In some embodiments, the connector 106 can be dragged or slid across the exterior surface of the housing 104. Upon the connector 106 traversing over the receptacle 102, magnetic forces attract, pull, snap, bias, etc. into place or position the connection interfaces of the receptacle 102 and the connector 106 (e.g., boss 150 and channel 134) to form a connection.

Engagement of the receptacle 102 and the connector 106 along directional arrows 160, 162 is for illustrative purposes. The span of directional arrows 160, 162 may be shorter than as illustrated in FIGS. 32 and 34, for example, as discussed herein, the connector 106 can be slid across the exterior surface of the housing 104 to engage with the receptacle 102. Accordingly, the travel length of the connector along directional arrows 160, 162 may be substantially equivalent to an extent of the channel 134 and/or boss 150 in the axial direction.

Figure 36:
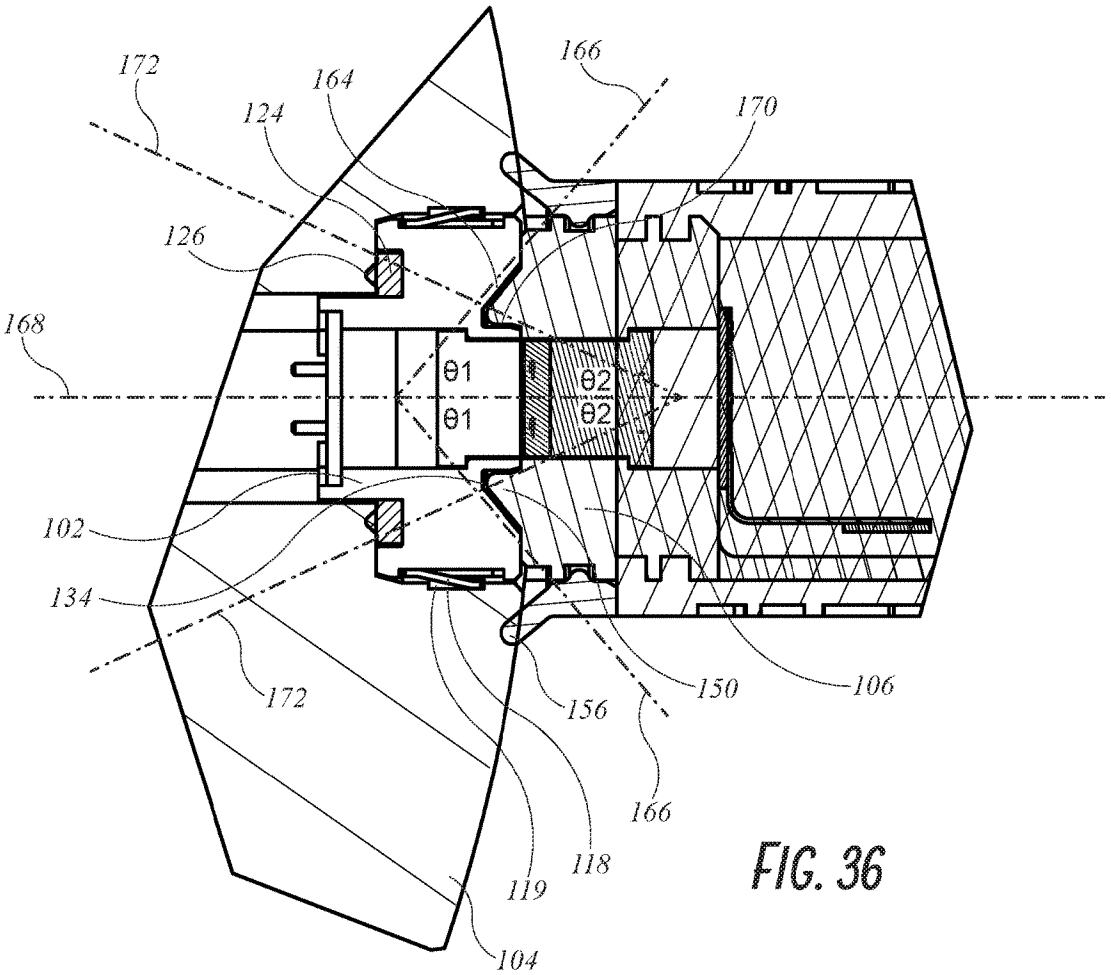
FIG. 36 illustrates a cross-sectional side view of embodiments of a receptacle and a connector.

FIG. 36 illustrates a cross-sectional side view of embodiments of the receptacle 102 and the connector 106 engaged with each other. As illustrated in FIG. 36, the receptacle 102 and/or connector 106 can have beveled, angled, and/or chamfered surfaces 164 corresponding to surfaces of the channel 134 and/or boss 150. The beveled surfaces 164 can be disposed at an angle θ1 as indicated by angle lines 166 relative to a central axis (longitudinal axis) 168, which can substantially correspond to the coupling axis, extending in an axial direction (axially) of the receptacle 102 and/or the connector 106 as discussed herein. In some embodiments, θ1 can vary between about 20° to about 80°, about 40° to about 70°, and about 45° to about 60°, including the foregoing values and ranges bordering therein. As illustrated, θ1 can be an acute angle relative to the central axis 168. As also illustrated, θ1 can be a non-parallel and non-perpendicular angle relative to the central axis 168.

The beveled surfaces 164 can facilitate engagement of the receptacle 102 and the connector 106 as discussed herein. For example, upon engagement of the receptacle 102 and the connector 106, when the boss 150 is not axially aligned with the channel 134 along the central axis 168, the beveled surfaces 164 can guide the boss 150 at a desired angle (θ1) into the channel 134. The beveled surfaces 164 and/or magnetic forces can facilitate aligning the boss 150 with the channel 134 in the lateral and longitudinal (and combinations thereof) directions as discussed herein, including rotating the connector 106 such that corresponding geometries of the channel are aligned as discussed (for example, corresponding heights and lengths are aligned).

As illustrated in FIG. 36, the receptacle 102 and/or connector 106 can have flat or generally parallel surfaces 170 corresponding to surfaces of the channel 134 and/or boss 150. The generally parallel surfaces 170 can be substantially parallel to the central axis 168. The generally parallel surfaces 170 can extend substantially along a same plane along the central axis 168. The generally parallel surfaces 170 can facilitate inhibiting or preventing lateral and longitudinal movements of the connector 106 relative to the receptacle 102 as discussed herein. For example, the generally parallel surfaces 170 can provide substantially perpendicular forces relative to the generally parallel surfaces 170 upon application of any force that would move the connector 106 laterally or longitudinally relative to the receptacle 102. Such forces can facilitate keeping the connector 106 coupled with the receptacle 102 upon engagement.

In some embodiments, the surfaces 170 can be disposed at an angle θ2 as indicated by angle lines 172 relative to a central axis 168 extending in an axial direction (axially) of the receptacle 102 and/or the connector 106 as discussed herein. In some embodiments, θ2 can vary between about 20° to about 80°, about 40° to about 70°, and about 45° to about 60°, including the foregoing values and ranges bordering therein. In some embodiments, θ2 can be an acute angle relative to the central axis 168. θ2 can be a non-parallel and non-perpendicular angle relative to the central axis 168. θ1 can be substantially the same or different than θ2 depending on desired balance between ease of engagement and desired (or lack thereof) lateral/longitudinal movements. Accordingly, having surfaces 170 sloped at θ2 can further facilitate engagement of the connection interfaces of the receptacle 102 and the connector 106 as discussed herein. As illustrated, in some embodiments, the surfaces 170 can be substantially parallel to the central axis 168 (e.g., θ2 is substantially zero).

The connection interfaces providing coupling mechanisms as discussed herein do not require or necessitate an axial force along a central axis (e.g., along central axis 168) to engage or disengage their connection interfaces. Accordingly, axial forces are substantially minimized, reduced, and/or eliminated on the connection interfaces of the receptacle 102 and the connector 106, as well as for example, the cable 108, which can result in reduced wear and tear to prolong the useful life of the connection interfaces.

The connection interfaces providing coupling mechanisms as discussed herein provide ease of maintenance. For example, the receptacle 102 as a beveled channel 134 as discussed herein without hidden grooves or cutouts where dirt and/or and debris can build up. Accordingly, the receptacle 102 can be easily cleaned by cleaning the substantially all exposed exterior surfaces of the receptacle 102.

Upon engagement of the receptacle 102 and the connector 106, the connection interfaces of the receptacle 102 and the connector 106 can provide tactile feedback that the coupling mechanisms as discussed herein are engaged. For example, upon engagement of the receptacle 102 and the connector 106, a user can feel the resistive forces (e.g., via the generally parallel surfaces 170) against further movement of the connector 106 relative to the receptacle 102 to provide tactile feedback that the coupling mechanisms (e.g., the channel 134 and the boss 150 as discussed herein) are engaged. The tactile feedback can include a snap-like engagement felt by the user upon engagement.

In addition to or in lieu of, the connection interfaces of the receptacle 102 and the connector 106 can provide audible feedback that the coupling mechanisms as discussed herein are engaged. For example, upon engagement of the receptacle 102 and the connector 106, a user may hear an audible noise indicating engagement of the connection interfaces. For example, upon engagement of the connection interfaces, a user may hear a snap. The audible feedback can range from about 30 dB to about 90 dB, including the foregoing values and ranges bordering therein.

Figure 37:
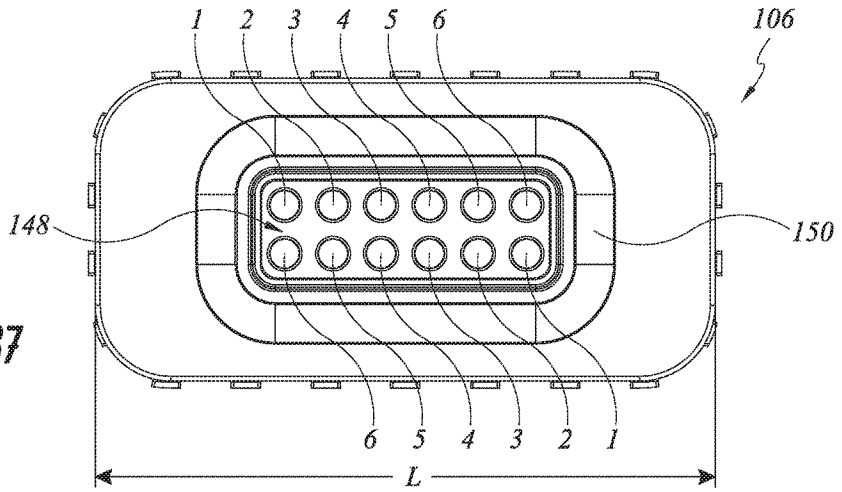
FIGS. 37-39 illustrate front views of embodiments of a connector.
Figure 38:
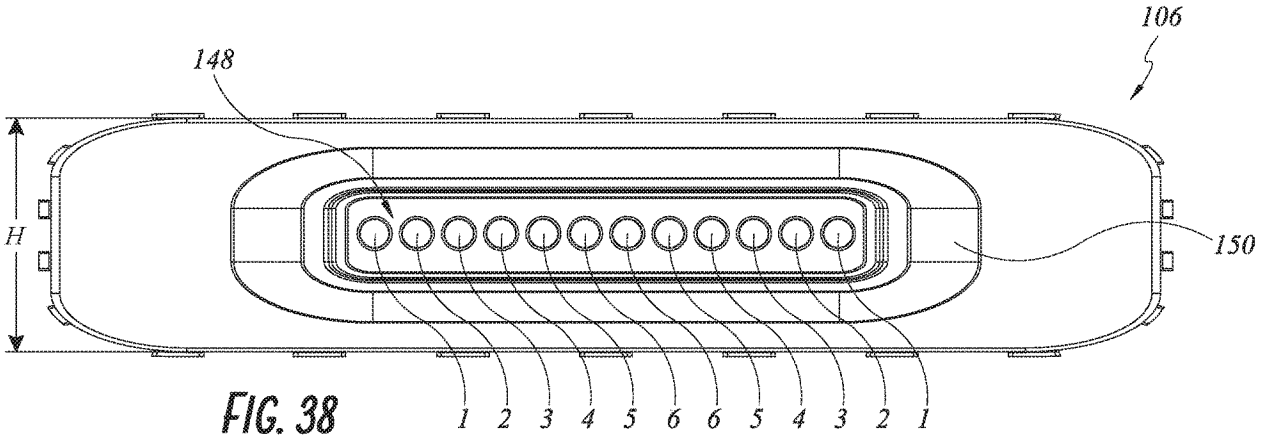
Figure 39:
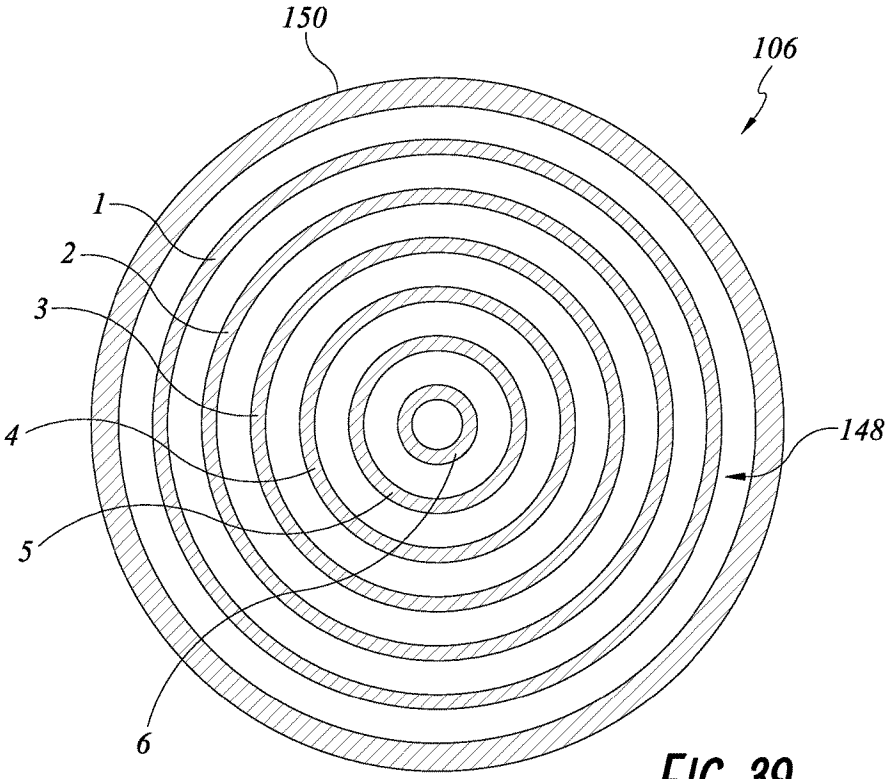
Figure 41A:
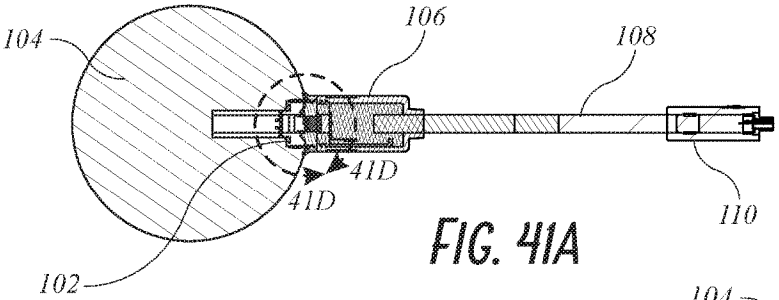
Figure 41C:
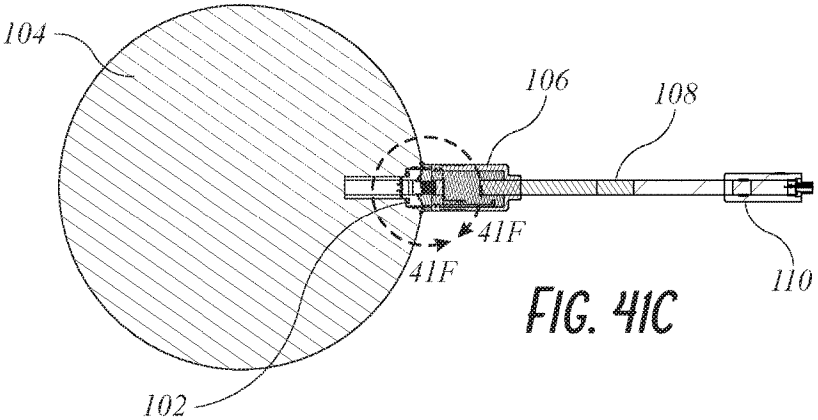
Figure 41B:
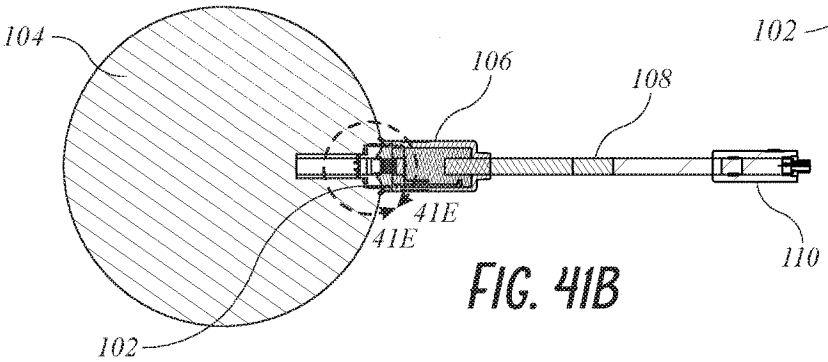
Figure 41F:
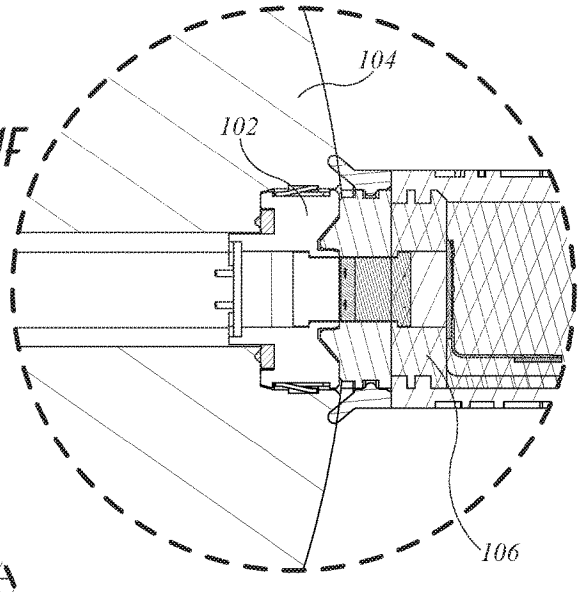
Figure 41E:
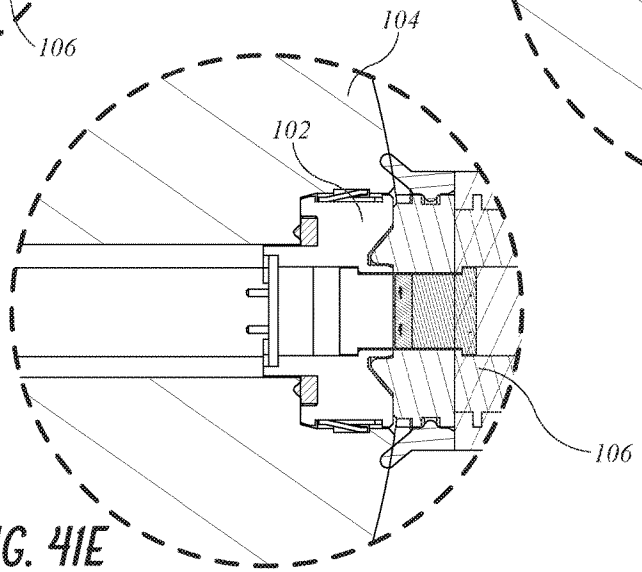
Figure 41D:
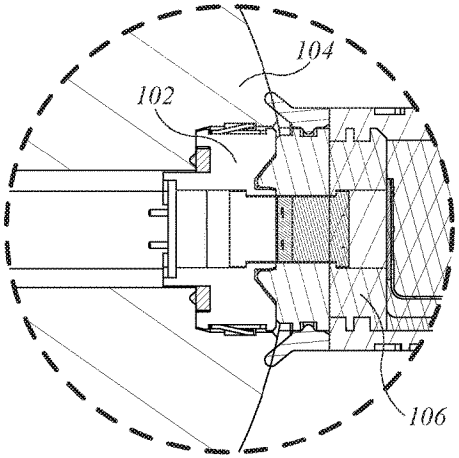

FIGS. 37-39 illustrate front views of certain additional embodiments of a connector 106. As illustrated in FIGS. 37 and 38, the connector 106 can be of a generally rectangular shape. The boss 150 (as well as the channel 134) can be correspondingly rectangular. For example, the length and width of the connector 106 and corresponding coupling mechanisms can be different such that the different length and width of the connector 106 will be aligned with the corresponding different length and width of the receptacle 102. Such geometries may be provided to align and connect with electrical contacts 130 in a desired orientation.

As illustrated in FIGS. 37 and 38, the electrical contacts 148 can be mirrored and/or flipped along a plane either parallel to a length L or height H to provide redundant circuitry and allow for various orientations (e.g., rotations of the connector 106) of the connection interfaces. For example, as illustrated in FIG. 37, the electrical contacts 148 labeled as 1, 2, 3, 4, 5, 6 are mirrored and flipped about length L at a central axis (e.g., central axis 168). As illustrated in FIG. 38, the electrical contacts 148 labeled as 1, 2, 3, 4, 5, 6 are mirrored about height H at a central axis (e.g., central axis 168). Accordingly, the connector 106 can be rotated 180° relative to the receptacle 102 and still be able to form the coupling mechanisms as discussed herein, as well as the proper electrical connections. As illustrated in FIGS. 37 and 38, the boss 150 of the connector 106 can have radiused corners (and correspondingly the channel 134 of the receptacle 102) to further facilitate orientation relative to and engagement of the connection interfaces.

FIG. 39 illustrates an embodiment of a connector 106 that is substantially circular. The electrical contacts 148 labeled as 1, 2, 3, 4, 5, 6 are correspondingly substantially circular. The circular electrical contacts 148 can extend about or circumscribe a central axis (e.g. central axis 168). The connector 106 can have a substantially circular boss 150 with the same or similar connection interfaces and features as discussed herein for other embodiments of the connector 106. The receptacle 102 can be substantially circular with corresponding circular electrical contacts 130. The receptacle 102 can have a correspondingly circular channel 134 with the same or similar connection interfaces and features as discussed herein for other embodiments of the receptacle 102. Accordingly, the connector 106 can be positioned at incident angular orientations relative to the receptacle 102 while still providing the coupling mechanisms as discussed herein.

FIGS. 40A-41F illustrate cross-sectional views of embodiments of the receptacle 102, the housing 104, and the connector 106. FIGS. 40A-41F illustrate various sizes, dimensions, and shapes of the receptacle 102, the housing 104, and the connector 106 as discussed herein. FIGS. 40A-41F illustrate how the receptacle 102 and the connector 106 can engage and function as discussed herein with relatively smaller to relatively larger housings 104, where the housing 104 increases in size (e.g., radius or other dimension) from FIG. 40A to FIG. 40C (correspondingly, FIG. 40D to FIG. 40F) and from FIG. 41A to FIG. 41C (correspondingly, FIG. 41D to FIG. 41F). The exterior surfaces 136, 138 of the receptacle 102 (and correspondingly exterior surfaces 152, 154 of the connector 106) have been illustrated as substantially flat or planar. Planar exterior surfaces 136, 138 can be substantially or generally flush to the exterior surfaces of the housing 104 as discussed herein for most circular or round housings 104. In some embodiments, the exterior surfaces 136, 138 of the receptacle 102 (and correspondingly exterior surfaces 152, 154 of the connector 106) can be contoured to the curvature of the housing 104 where, for example, the radius of curvature of the housing 104 is below a predetermined threshold. The radius of the exterior surfaces 152, 154 can be formed to substantially match or correspond to a radius of curvature of the housing 104.

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the inventions are susceptible to various modifications, and alternative forms, specific examples thereof have been shown in the drawings and are herein described in detail. It should be understood, however, that the inventions are not to be limited to the particular forms or methods disclosed, but to the contrary, the inventions are to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "passing a suspension line through the base of the tongue" include "instructing the passing of a suspension line through the base of the tongue." It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than or equal to 10% of the stated amount. Features of embodiments disclosed herein preceded by a term such as "approximately", "about", and "substantially" as used herein represent the feature with some variability that still performs a desired function or achieves a desired result for that feature. The term "substantially flush" or "generally flush" as used herein may refer to surfaces that are in the same plane or are co-planar, with the respective plane corresponding to each surface being separated by a distance of less than or equal to 3 millimeters. The term "generally" as used herein represents a value, amount, or characteristic that predominantly includes, or tends toward, a particular value, amount, or characteristic. As an example, in certain embodiments, as the context may dictate, the term "generally parallel" can refer to something that departs from exactly parallel by less than or equal to 20 degrees, and the term "generally perpendicular" can refer to something that departs from exactly perpendicular by less than or equal to 20 degrees.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present subject matter has been described herein in terms of certain embodiments, and certain exemplary methods, it is to be understood that the scope of the subject matter is not to be limited thereby. Instead, the Applicant intends that variations on the methods and materials disclosed herein which are apparent to those of skill in the art will fall within the scope of the disclosed subject matter.

What is claimed is:

1. A connection interface comprising:

a receptacle configured to be positioned in a wall of an electrical device, the receptacle comprising:

a first set of electrical contacts; and a channel comprising a first angled surface, the first angled surface being at a non-parallel and non-perpendicular angle with respect to a longitudinal axis of the connection interface; and a connector configured to be matingly engaged with the receptacle in an engaged state and to be separated from the receptacle in a disengaged state, the connector comprising:

a second set of electrical contacts; and a boss comprising a second angled surface, the second angled surface being at a non-parallel and non-perpendicular angle with respect to the longitudinal axis of the connection interface, wherein the boss projects longitudinally beyond, and extends around to circumscribe, the second set of electrical contacts;

wherein the first and second angled surfaces are configured to interact as the connector is moved into engagement with the receptacle, thereby guiding the connector into the receptacle such that the first and second sets of electrical contacts are in electrical communication with each other; and wherein the first and second angled surfaces are at an angle, relative to the longitudinal axis, of about 45° to about 60°.

2. The connection interface of claim 1, wherein the receptacle and connector are configured to engage together in at least a first relative orientation and a second relative orientation.

3. The connection interface of claim 2, wherein, from the first relative orientation, the second relative orientation is achieved by rotating the connector about the longitudinal axis by approximately 180°.

4. The connection interface of claim 1, wherein in the engaged state, the boss of the connector is received in the channel of the receptacle.

5. The connection interface of claim 1, wherein the connector further comprises a magnetic element configured to attract the receptacle.

6. The connection interface of claim 1, wherein the connector further comprises a gland configured to seal against the wall of the electrical device.

7. The connection interface of claim 6, wherein the gland is positioned on an outer peripheral wall of the connector.

8. The connection interface of claim 6, wherein the gland is configured to seal against a generally cylindrical surface.

9. The connection interface of claim 6, wherein the gland is configured to provide sealing around substantially an entirety of a periphery of the connection interface between the connector and the receptacle.

10. The connection interface of claim 1, wherein the first and second angled surfaces are at an angle, relative to the longitudinal axis, of approximately 60°.

11. The connection interface of claim 1, wherein the receptacle comprises a first parallel surface that is substantially parallel to the longitudinal axis, wherein the receptacle comprises a second parallel surface that is substantially parallel to the longitudinal axis, and wherein the first and second parallel surfaces are configured to interact to inhibit lateral movement of the connector relative to the receptacle with the engagement of the connector to the receptacle.

12. The connection interface of claim 11, wherein the receptacle comprises a first perpendicular surface that is substantially perpendicular to the longitudinal axis, the first perpendicular surface connecting the first angled and parallel surfaces of the receptacle, wherein the receptacle comprises a second perpendicular surface that is substantially perpendicular to the longitudinal axis, the second perpendicular surface connecting the second angled and parallel surfaces of the connector, and wherein the first and second perpendicular surfaces are configured to be in contact with the engagement of the connector to the receptacle.

13. A receptacle configured to be positioned in a wall of an electrical device, the receptacle comprising:

a first set of electrical contacts; and a channel comprising a first angled surface, the first angled surface being at an acute angle with respect to a coupling axis of the receptacle, wherein the channel surrounds the first set of electrical contacts;

the receptacle configured to removably engage with a connector along the coupling axis, the connector comprising a second set of electrical contacts and a boss having a second angled surface; and the first angled surface of the receptacle being configured to interface with the second angled surface of the connector as the connector is moved into engagement with the receptacle, thereby guiding the connector into the receptacle such that the first and second sets of electrical contacts are in electrical communication with each other, wherein a first exterior surface adjacent the first set of electrical contacts is generally flush with a second exterior surface adjacent the channel.

14. The receptacle of claim 13, wherein the receptacle is generally flush with the wall of the electrical device.

15. The receptacle of claim 13, wherein the receptacle is configured to engage with the connector in at least a first relative orientation and a second relative orientation.

16. The receptacle of claim 15, wherein, from the first relative orientation, the second relative orientation is achieved by rotating the connector about a longitudinal axis of the connector by approximately 180°.

17. A connector comprising:

a set of connector electrical contacts; and a boss comprising an angled surface, the angled surface being at an acute angle with respect to a coupling axis of the connector, wherein the boss projects longitudinally beyond, and extends around to circumscribe, the set of connector electrical contacts;

the connector configured to be removably engaged with a receptacle along the coupling axis, the receptacle comprising a set of receptacle electrical contacts and a channel; and the angled surface of the boss being configured to interact with a corresponding angled surface of the channel of the receptacle when the connector is moved into engagement with the receptacle, thereby guiding the connector into the receptacle such that the connector and receptacle electrical contacts are in electrical communication with each other, wherein the angled surface is at an angle, relative to the coupling axis, of about 45° to about 60°.

18. The connector of claim 17, wherein the receptacle is configured to engage with the receptacle in at least a first orientation and a second orientation.

19. The connector of claim 18, wherein, from the first orientation, the second orientation is achieved by rotating the connector about a longitudinal axis of the connector by approximately 180°.

20. The connector of claim 17, wherein the connector further comprises a magnetic element configured to apply a magnetic force to the receptacle during engagement of the connector and the receptacle.

21. The connector of claim 20, wherein the magnetic element is positioned along the coupling axis behind an exterior surface of the connector generally about the boss.

22. The connector of claim 17, wherein the connector further comprises a gland configured to seal against a wall in longitudinal and lateral directions, the receptacle configured to be in the wall.

23. The connector of claim 22, wherein the gland is configured to extend from a periphery of the connector at an angle between about 20° to about 80° relative to the coupling axis.

24. The connector of claim 17, wherein a first exterior surface generally about the connector electrical contacts is generally flush with a second exterior surface generally about the boss.

25. The connector of claim 17, wherein the boss extends completely around the set of connector electrical contacts.

26. The connector of claim 17, wherein the connector further comprises a gland configured to seal against a plurality of walls in longitudinal and lateral directions, the receptacle configured to be in each of the plurality of walls, with the plurality of walls having various dimensions or shapes.

27. The connector of claim 17, wherein the set of connector electrical contacts are positioned within an inner perimeter of the boss.

* * * * *